US012677917B2

(12) United States Patent
Jackson

(10) Patent No.: US 12,677,917 B2
(45) Date of Patent: Jul. 14, 2026

(54) PIECE OF LUGGAGE WITH A HANDLE-TO-STAND CONVERSION FEATURE

(71) Applicant: Valerie Jackson, Baltimore, MD (US)

(72) Inventor: Valerie Jackson, Baltimore, MD (US)

( * ) Notice: Subject to any disclaimer, the term of this patent is extended or adjusted under 35 U.S.C. 154(b) by 181 days.

(21) Appl. No.: 18/742,870

(22) Filed: Jun. 13, 2024

(65) Prior Publication Data

US 2025/0380776 A1 Dec. 18, 2025

(51) Int. Cl.

| | |
|---|---|
| ***A45C 9/00*** | (2006.01) |
| ***A45C 5/03*** | (2006.01) |
| ***A45C 5/14*** | (2006.01) |
| ***A45C 13/26*** | (2006.01) |
| ***A45C 13/28*** | (2006.01) |
| ***A45C 15/00*** | (2006.01) |

(52) U.S. Cl.

CPC ..... *A45C 9/00* (2013.01); *A45C 5/03* (2013.01); *A45C 5/146* (2013.01); *A45C 13/262* (2013.01); *A45C 13/28* (2013.01); *A45C 15/00* (2013.01); *A45C 2013/267* (2013.01); *A45C 2200/15* (2013.01)

(58) Field of Classification Search

CPC .. A45C 9/00; A45C 5/03; A45C 5/146; A45C 13/262; A45C 13/28; A45C 15/00; A45C 2013/267; A45C 220/15

USPC ..... 190/11

See application file for complete search history.

(56) References Cited

U.S. PATENT DOCUMENTS 4,856,627 A 8/1989 Polatov
6,213,265 B1 * 4/2001 Wang ..... A45C 9/00 280/37
6,237,734 B1 5/2001 Chen
(Continued)

FOREIGN PATENT DOCUMENTS

CA 2540900 A1 * 3/2007 ..... A63F 7/0017
CN 109431041 A * 3/2019 ..... A45C 13/28
(Continued)

OTHER PUBLICATIONS

Deskit, Deskit School Bag Convertible Into Study Table, retrieved from Internet, retrieved on Jun. 13, 2024, <URL: https://www.tradeindia.com/products/red-polyester-school-bag-with-detachable-table-c6997231.html>.

*Primary Examiner* — Nathan J Jenness
*Assistant Examiner* — Jessica Kavini Tamil

(57) ABSTRACT

A piece of luggage with a handle-to-stand conversion feature is an apparatus that can be used to comfortably support a computing device, such as a laptop, without requiring the use of external accessories. The apparatus includes a luggage body and a pull handle. The luggage body corresponds to the structure of the apparatus that securely retains and protects the user's personal belongings while traveling. The luggage body is also designed to accommodate and support the different configurations of the pull handle. The pull handle is designed to be manually arranged into different configurations by the user while travelling to provide different functionalities. In a handle configuration, the pull handle facilitates the transportation of the luggage body along with the stored personal belongings. In a platform configuration, the pull handle supports a computing device above the luggage body so that the user can comfortably use the computing device anywhere while traveling.

19 Claims, 31 Drawing Sheets

(56) References Cited

U.S. PATENT DOCUMENTS

| | | | | |
|---|---|---|---|---|
| 8,567,577 | B2 | 10/2013 | Jackson | |
| 11,140,958 | B1 * | 10/2021 | Baldwin | A45C 11/00 |
| 2009/0095762 | A1 * | 4/2009 | Jung | A45C 13/001 220/737 |
| 2011/0056788 | A1 | 3/2011 | Jackson | |
| 2012/0126500 | A1 * | 5/2012 | Rankin | A45C 5/145 280/47.2 |
| 2017/0224074 | A1 | 8/2017 | Bourette | |
| 2018/0242702 | A1 * | 8/2018 | Shah | A45C 15/00 |
| 2019/0045937 | A1 | 2/2019 | Reynolds | |
| 2022/0071392 | A1 | 3/2022 | Hanks | |

FOREIGN PATENT DOCUMENTS

| | | | |
|---|---|---|---|
| EP | 1045654 | A1 | 10/2000 |
| EP | 3764837 | A1 | 1/2021 |

* cited by examiner

PIECE OF LUGGAGE WITH A HANDLE-TO-STAND CONVERSION FEATURE

FIELD OF THE INVENTION

The present invention generally relates to travel equipment and laptop accessories. More specifically, the present invention discloses a piece of luggage that can be used for travel that can be configured to be used as a laptop stand.

BACKGROUND OF THE INVENTION

Travel has become a common activity in many people's lives. The number of people traveling for business or leisure has greatly increased due to more accessible means of travel. For example, air travel has become more efficient and affordable to many which enables people to travel more often. However, modern travel includes many inconveniences regardless of the advances in technology. For example, most travelers have faced the inconvenience of spending long periods of time at the airport while waiting for their flight. To pass the time, people often bring different items with them while traveling. For example, many people bring a laptop or other computing device to have some entertainment or to perform school/job related work while traveling. Many accessories have been made available to help people use a laptop on the go, especially while traveling. While useful, these accessories can be a hassle to carry around since each accessory can take up additional baggage space. This can be a greater problem today since the amount of baggage allowed to be carried by each traveler has been restricted. Therefore, a better option for people to use a laptop or similar computing device while traveling without carrying additional accessories is necessary.

To help alleviate these issues, an objective of the present invention is to provide a piece of luggage with a convertible handle that can be configured to be used as a laptop stand. The present invention can be provided as carry-on luggage equipped with a convertible handle. The convertible handle of the present invention can be configured to be used as a traditional pull handle from which the user can move the luggage. In addition, the convertible handle can be configured into a stand that can support a laptop or other computing device. Another objective of the present invention is to provide a piece of luggage with lateral support features designed to prevent the luggage from tipping over while the convertible handle is supporting a computing device. The lateral support features can be selectively deployed whenever the user wants to use the convertible handle as a laptop stand. This way, the convertible handle provides a stable and secure platform that supports the computing device without the use of external accessories. Additional features and benefits of the present invention are further discussed in the sections below.

SUMMARY OF THE INVENTION

The present invention discloses a piece of luggage with a handle-to-stand conversion feature. The handle-to-stand conversion feature of the present invention allows users to utilize the piece of luggage as a laptop stand without the need for external accessories that increase the amount of baggage the user needs to transport while traveling. To do so, the present invention includes a pull handle and a luggage body. The luggage body provides the storage space for the user to carry personal items safely while traveling.

The luggage body can be provided in different shapes and sizes that accommodate different amounts of items inside the luggage body. Further, the pull handle has a convertible structure that allows the user to configure the pull handle to be used as a traditional pull handle from which the user can move the luggage body. In addition, the device handle can also be configured into a stand that supports a laptop or other computing devices at an appropriate height from the ground. This way, the user can comfortably utilize a laptop or other computing device without having to utilize other accessories that can increase the amount of baggage the user has to transport while traveling.

DETAILED DESCRIPTION OF THE INVENTION

Figure 1:
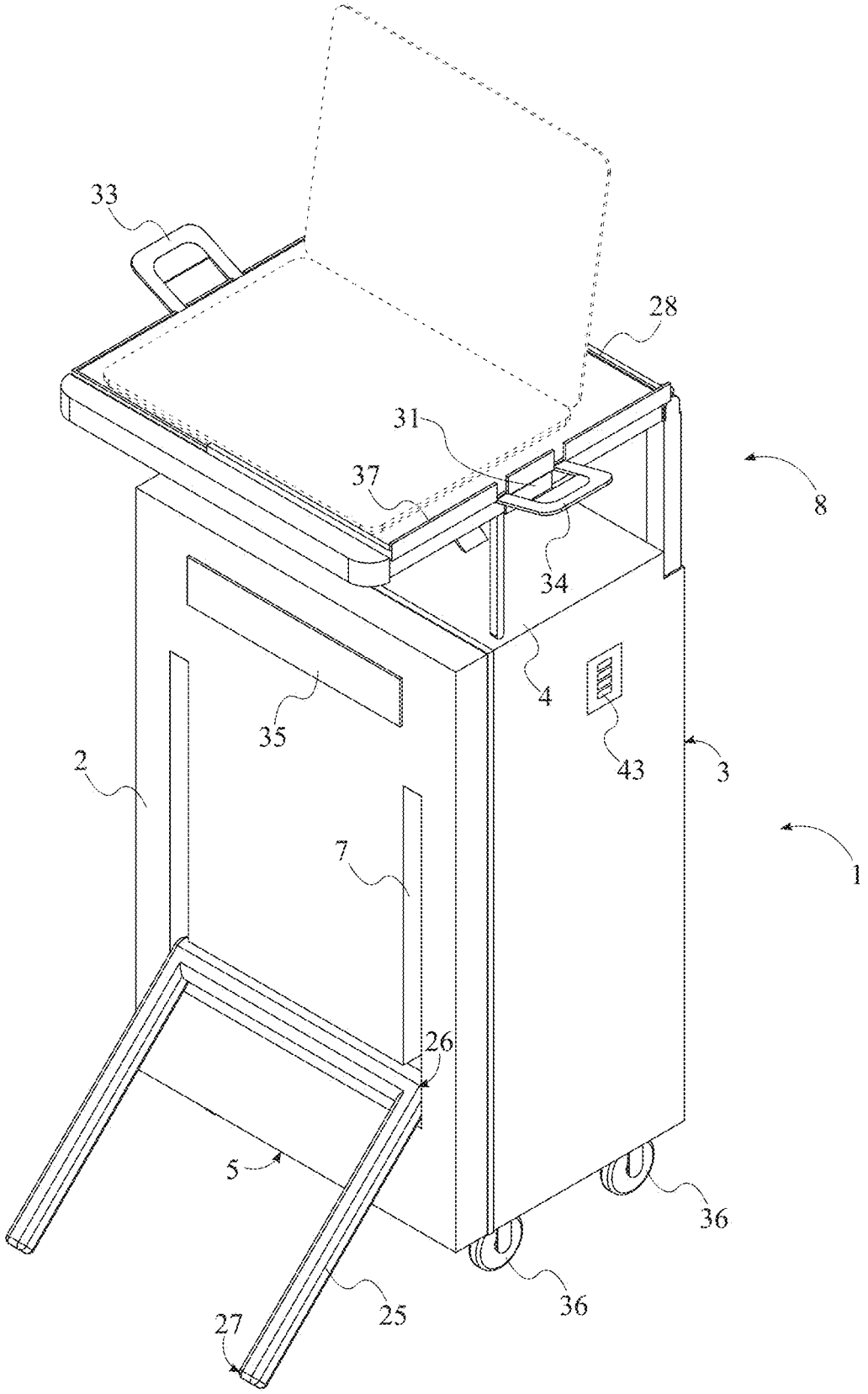
FIG. 1 is a top-front-left perspective view of the present invention, wherein a pull handle and a laptop tray are shown in a platform configuration, wherein a front kick stand, a rear kick stand, and kickout support rods are shown deployed, and wherein a computing device is shown placed on the laptop tray mounted onto the pull handle.
Figure 2:
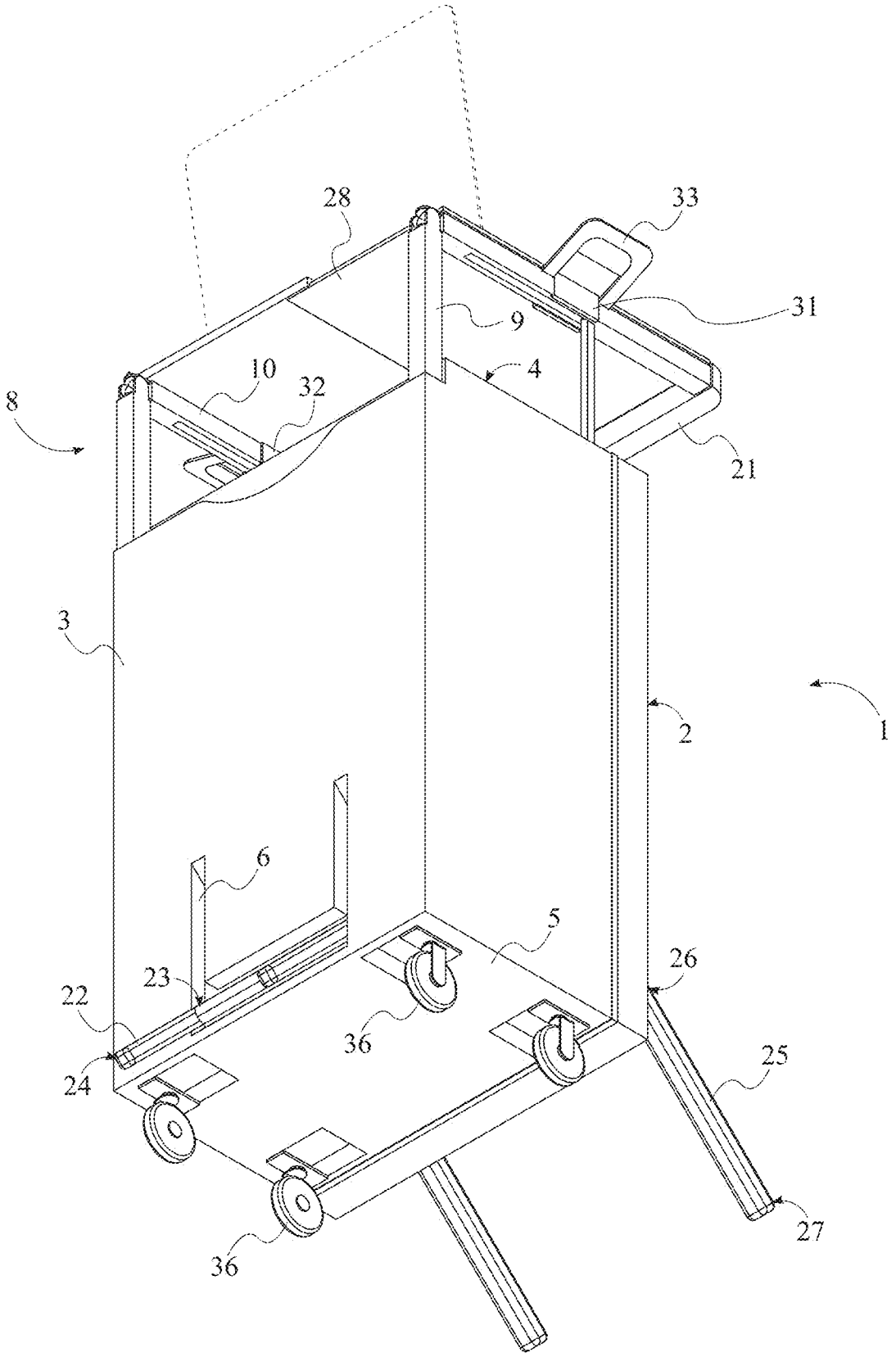
FIG. 2 is a bottom-rear-right perspective view thereof.
Figure 3:
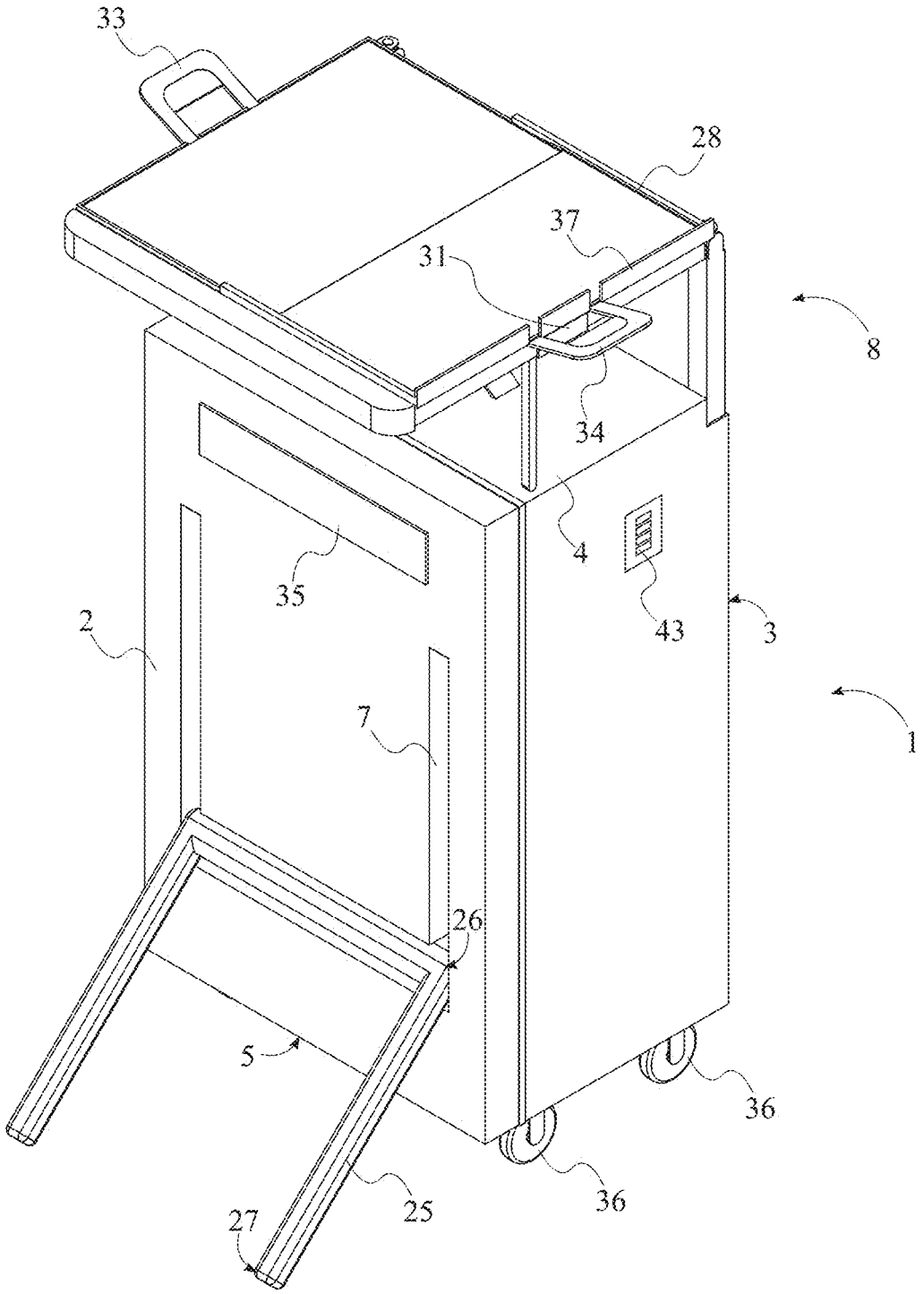
FIG. 3 is a top-front-left perspective view of the present invention, wherein the pull handle and the laptop tray are shown in the platform configuration without a computing device.
Figure 4:
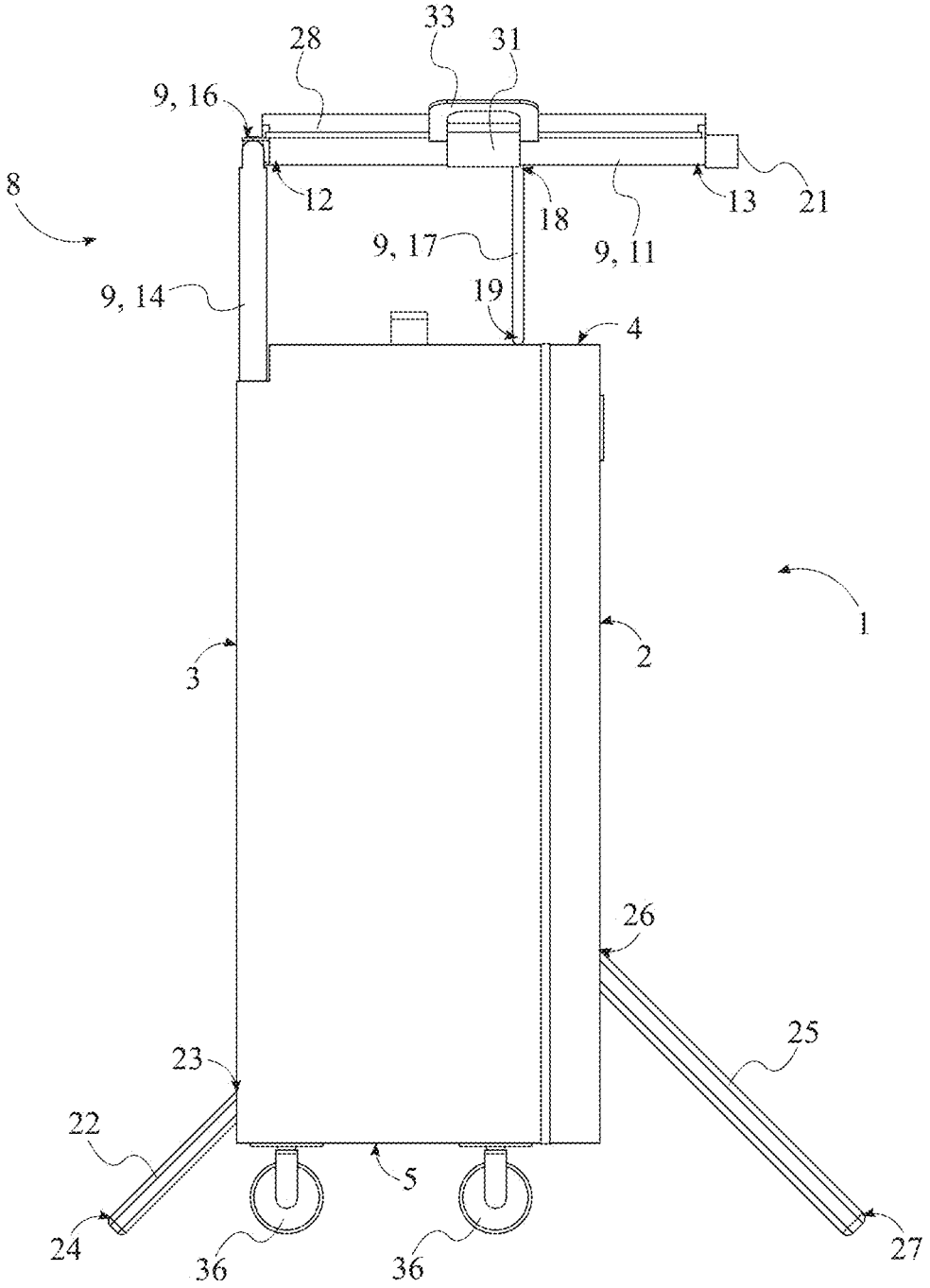
FIG. 4 is a right-side view thereof.
Figure 5:
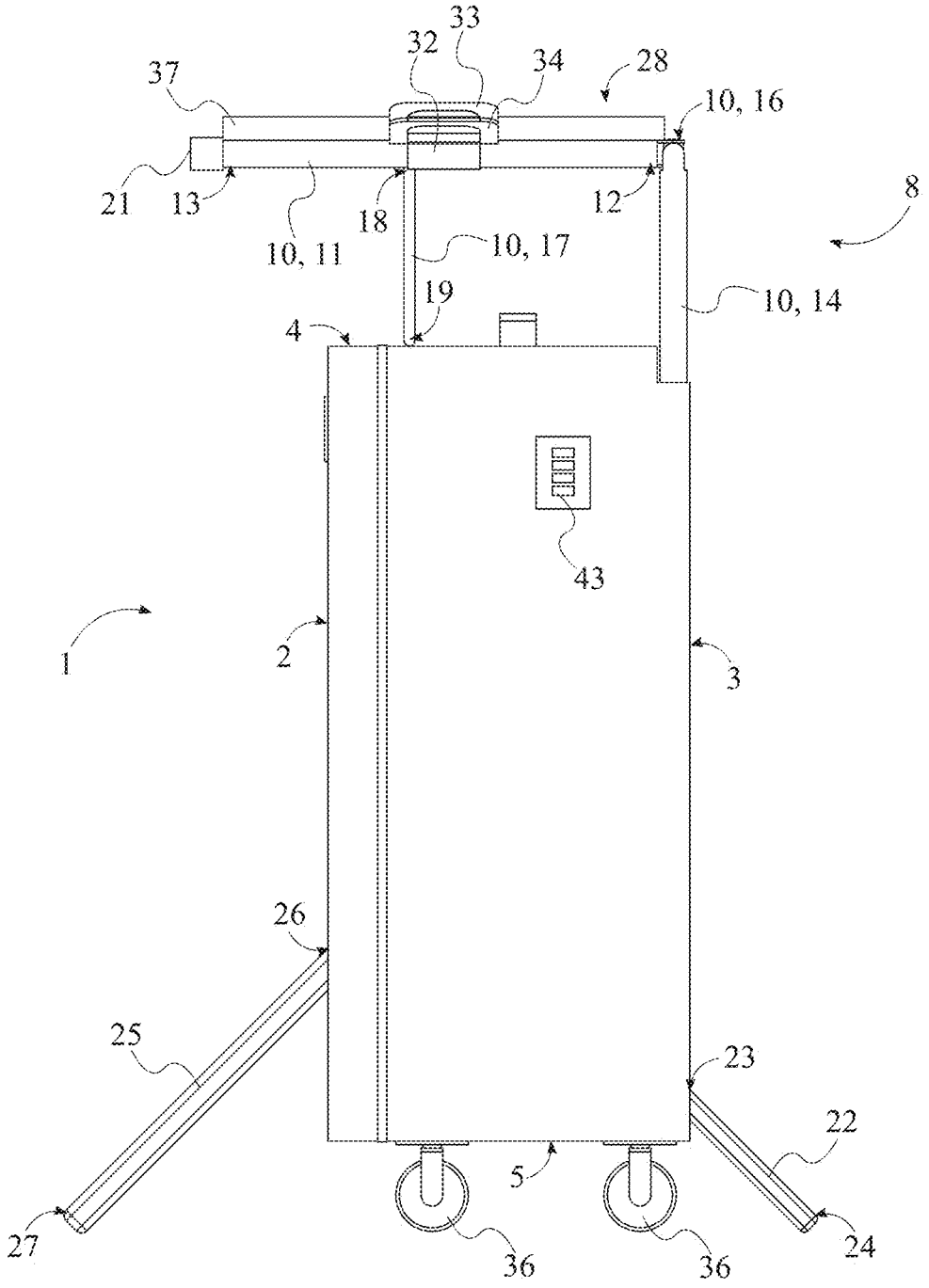
FIG. 5 is a left-side view thereof.

All illustrations of the drawings are for the purpose of describing selected versions of the present invention and are not intended to limit the scope of the present invention.

The present invention discloses a piece of luggage with a handle-to-stand conversion feature. The present invention can be used to carry a desired number of personal belongings while travelling as a traditional piece of luggage. The present invention can also be arranged to support a computing device such as a laptop or other portable computing devices for comfortable use while traveling without the need for a table or other flat surface. As can be seen in FIGS. 1 through 26, the present invention comprises a luggage body 1 and a pull handle 8. The luggage body 1 corresponds to the structure of the present invention that securely retains and protects the user's personal belongings while traveling. The luggage body 1 is also designed to accommodate and support the different configurations of the pull handle 8. The pull handle 8 includes a convertible structure that can be manually arranged by the user into different configurations to provide different functionalities. For example, in a handle configuration, the pull handle 8 can be used to move the luggage body 1 with the stored belongings inside. In a platform configuration, the pull handle 8 can be used as a stand where the user can comfortably operate a laptop or other computing device. Further, in a holder configuration, the pull handle 8 can be used to retain the computing device in a vertical orientation for the user to comfortably watch the display of the computing device without holding the computing device.

The general configuration of the aforementioned components allows the user to comfortably utilize a portable computing device by configuring a piece of luggage to be used as a laptop stand or as a device holder. As can be seen in FIGS. 1 through 26, the luggage body 1 can be designed as a rectangular hollow structure large enough to safely retain a predetermined amount of personal items. For example, the luggage body 1 can be designed with a size and shape that meets the standards for a carry-on bag. However, different shapes and sizes can be implemented for the luggage body 1 to meet different baggage requirements. Further, the luggage body 1 can be made from different materials that provide different levels of protection to the stored items that meet specific travel regulations. For example, the luggage body 1 can include a solid shell structure that protects the stored items from external impacts. However, other durable soft materials can be implemented that allow the luggage body 1 to be more flexible overall while still providing an acceptable of protection to the stored items.

As can be seen in FIGS. 1 through 26, in the rectangular embodiment of the present invention, the luggage body 1 comprises a front side 2, a rear side 3, a top side 4, and a bottom side 5. The front side 2 preferably corresponds to the side of the luggage body 1 from where the user can access the internal storage space of the luggage body 1. For example, the front side 2 can incorporate a lid structure that is hingedly connected to a lateral side of the luggage body 1 so that the user can selectively open the luggage body 1 as desired. The lid structure can also be fastened to the rest of the luggage body 1 using an integrated fastening mechanism that can be easily operated by the user. For example, the fastening mechanism can be a zipper mechanism that allows the user to selectively seal/unseal the luggage body 1 to access the storage space inside. In other embodiments, different fastening mechanisms can be implemented that may also incorporate a locking mechanism to prevent unauthorized access. Further, the rear side 3 corresponds to the opposite side of the front side 2 that accommodates the pull handle 8. The top side 4 corresponds to the side of the luggage body 1 that is oriented away from the ground when the luggage body 1 is positioned upright. Furthermore, the bottom side 5 corresponds to the side of the luggage body 1 that is positioned against the ground when the luggage body 1 is positioned upright.

As previously discussed, the pull handle 8 includes a convertible structure that allows the user to reconfigure the pull handle 8 manually. As can be seen in FIGS. 1 through 18, the pull handle 8 is designed as a lightweight frame with configurable components that can be adjusted in length. So, the pull handle 8 comprises a first hinged telescopic support 9, a second hinged telescopic support 10, and a crossbar 21 that form the telescopic structure of the pull handle 8. The first hinged telescopic support 9 and the second hinged telescopic support 10 correspond to the configurable components that are adjustable in length using the telescopic features of each telescopic support. The first hinged telescopic support 9 and the second hinged telescopic support 10 also allow the pull handle 8 to be selectively configured into a platform configuration to support a computing device when necessary. In addition, the first hinged telescopic support 9 and the second hinged telescopic support 10 also allow the pull handle 8 to be selectively configured into a holder configuration to retain a computing device. The crossbar 21 corresponds to the traversal component that connects the first hinged telescopic support 9 to the second hinged telescopic support 10 to form a single structure. The crossbar 21 also provides a portion from which the user can hold onto the pull handle 8 to move the luggage body 1 when the pull handle 8 is in a handle configuration.

In the preferred embodiment, the present invention can be arranged as follows. As can be seen in FIGS. 1 through 18, the first hinged telescopic support 9 and the second hinged telescopic support 10 are positioned parallel and offset from each other to form the frame of the pull handle 8. In addition, the first hinged telescopic support 9 and the second hinged telescopic support 10 are anchored into the luggage body 1, adjacent to the rear side 3. This way, the pull handle 8 can be secured to the luggage body 1 without obstructing the telescopic features of the telescopic supports of the pull handle 8. Further, the crossbar 21 is positioned external to the luggage body 1, adjacent to the top side 4, so that the crossbar 21 can always be accessible to the user for easy storage and retrieval.

This way, the user can retrieve the pull handle 8 from the crossbar 21 when the pull handle 8 is stored away in the luggage body 1. Furthermore, the crossbar 21 is terminally connected in between the first hinged telescopic support 9 and the second hinged telescopic support 10, offset from the luggage body 1, to secure the crossbar 21 to the first hinged telescopic support 9 and the second hinged telescopic support 10. Thus, a secure and stable frame is formed for the pull handle 8 that can be deployed to be used as a traditional pull handle 8 or converted into a laptop stand when necessary. In other embodiments, different arrangement of components can be implemented that allow the present invention to be arranged into different configurations.

As previously discussed, the first hinged telescopic support 9 and the second hinged telescopic support 10 are designed to enable the pull handle 8 to be used to move the luggage body 1 in the handle configuration or be reconfigured to support/retain a laptop or other portable computing device. As can be seen in FIGS. 1 through 18, the first hinged telescopic support 9 and the second hinged telescopic support 10 each comprise a distal support bar 11, a proximal support bar 14, and a structural support tube 15. The structural support tube 15 corresponds to the structure that houses the distal support bar 11 and the proximal support bar 14 of each telescopic support when the pull handle 8 is stored away. The distal support bar 11 and the proximal support bar 14 correspond to the modular portions of each telescopic support that allow the pull handle 8 to be converted into the desired configuration to support/retain the target portable computing device. Further, the distal support bar 11 and the proximal support bar 14 are preferably designed as two elongated bars. The distal support bar 11 and the proximal support bar 14 can be of equal length, or the length of each support bar may differ from each other. Further, the distal support bar 11 comprises a fixed bar end 12 and a free bar end 13 corresponding to the terminal ends of each support bar.

In the preferred embodiment, the first hinged telescopic support 9 and the second hinged telescopic support 10 can be arranged as follows. As can be seen in FIGS. 1 through 18, the structural support tube 15 is integrated into the luggage body 1, adjacent to the rear side 3, to accommodate the corresponding telescopic support. The proximal support bar 14 is telescopically engaged into the structural support tube 15 so that the proximal support bar 14 allows the corresponding telescopic support to be stored into the structure tube when the pull handle 8 is stored away. When the pull handle 8 is retrieved, the proximal support bar 14 extends out of the structural support tube 15 without the proximal support bar 14 disconnecting from the structural support tube 15. Further, the fixed bar end 12 is hingedly and terminally connected to the proximal support bar 14, offset from the structural support tube 15. The hinged connection between the fixed bar end 12 and the proximal support bar 14 allows the distal support bar 11 to be oriented at an angle with the proximal support bar 14 in the platform configuration. Further, the free bar end 13 of the first hinged telescopic support 9 is terminally connected to the crossbar 21 to secure the crossbar 21 to the distal support bar 11 of the first hinged telescopic support 9. Likewise, the free bar end 13 of the second hinged telescopic support 10 is terminally connected to the crossbar 21, opposite to the free bar end 13 of the first hinged telescopic support 9, to secure the crossbar 21 to the distal support bar 11 of the second hinged telescopic support 10. Thus, the crossbar 21 is connected between the first hinged telescopic support 9 and the second hinged telescopic support 10 without obstructing the telescopic features of the first hinged telescopic support 9 and the second hinged telescopic support 10.

The hinged connection between the proximal support bar 14 and the distal support bar 11 allows the first hinged telescopic support 9 and the second hinged telescopic support 10 to be oriented at an angle in the platform configuration. As can be seen in FIGS. 1 through 18, the first hinged telescopic support 9 and the second hinged telescopic support 10 may each further comprise a lockable U-joint 16. The lockable U-joint 16 allows each distal support bar 11 to be oriented at a desired angle with the corresponding proximal support bar 14. So, the fixed bar end 12 is hingedly and terminally connected to the proximal support bar 14, offset from the structural support tube 15, by the lockable U-joint 16. In the preferred embodiment, the lockable U-joint 16 is designed to allow each distal support bar 11 to be oriented perpendicular with the corresponding proximal support bar 14. This way, the first hinged telescopic support 9 and the second hinged telescopic support 10 can each be arranged into a L-shaped configuration where each distal support bar 11 provides a supporting structure in the platform configuration. On the other hand, each proximal support bar 14 offsets the corresponding distal support bar 11 from the top side 4 to elevate the supported laptop or other computing device. Further, the lock feature of each lockable U-joint 16 prevents the corresponding telescopic support from changing configurations inadvertently.

Due to the load of the computing device placed on the pull handle 8 during the platform configuration, the first hinged telescopic support 9 and the second hinged telescopic support 10 may require additional structural support so that lockable U-joint 16 of each telescopic support does not fail. As can be seen in FIGS. 1 through 18, the first hinged telescopic support 9 and the second hinged telescopic support 10 may each further comprise a kickout support rod 17 and a rod-receiving slot 20. The kickout support rod 17 is designed to provide structural support to the corresponding distal support bar 11 when the pull handle 8 is arranged into the platform configuration. The rod-receiving slot provides a storage space on the corresponding distal support bar 11 where the corresponding kickout support rod 17 can be stored away when not in use. The kickout support rod 17 is preferably an elongated thin structure with a length matching the distance between the distal support bar 11 and the top side 4 in the platform configuration. This way, the distal support bar 11 is kept parallel to the top side 4 while the pull handle 8 is in the platform configuration. Further, the kickout support rod 17 comprises a fixed rod end 18 and a free rod end 19 corresponding to the terminal ends of the kickout support rod 17.

As can be seen in FIGS. 1 through 18, to implement the kickout support rod 17 and the rod-receiving slot 20, the rod-receiving slot 20 laterally traverses into the distal support bar 11 to form a space on the distal support bar 11 that accommodates the kickout support rod 17. The rod-receiving slot 20 is preferably oriented towards the front side 2 so that the kickout support rod 17 is deployed towards the top side 4 when the pull handle 8 is used in the platform configuration. The rod-receiving slot 20 comprises a shape and size that matches the shape and size of the kickout support rod 17. The rod-receiving slot can include a notch or gap that allows the user to manually release the kickout support rod 17 from the rod-receiving slot 20. Further, the fixed rod end 18 is positioned within the rod-receiving slot 20 so that the fixed rod end 18 can be hingedly connected to the distal support bar 11. This way, the kickout support rod 17 is secured to the distal support bar 11 while enabling the kickout support rod 17 to be deployed to provide structural support to the distal support bar 11 in the platform configuration. In other embodiments, different support mechanisms can be implemented to keep the pull handle 8 stable when used in the platform configuration.

When the user is utilizing the pull handle 8 in the platform configuration, the user may inadvertently move the luggage body 1 which can affect the stability of the pull handle 8 and the portable computing device resting on the pull handle 8. So, the additional structural support can be provided on the luggage body 1 to prevent the luggage body 1 from accidentally moving when the user is utilizing the computing device. As can be seen in FIGS. 1 through 18, in one embodiment, the present invention may further comprise at least one rear kick stand 22 that provides lateral support to the luggage body 1 from the rear side 3. In addition, the luggage body 1 may further comprise at least one rear stand-receiving slot 6 that provides a storage space for the at least one rear kick stand 22. Similar to the kickout support rod 17, the at least one rear kick stand 22 is preferably a lightweight elongated structure that can be manually deployed by the user. So, the at least one rear kick stand 22 comprises a rear fixed stand end 23 and a rear free stand end 24 corresponding to the terminal ends of the elongated structure of the at least one rear kick stand 22.

As can be seen in FIGS. 1 through 18, to integrate the at least one rear kick stand 22 and the at least one rear stand-receiving slot 6 on the luggage body 1, the at least one rear stand-receiving slot 6 traverses from the rear side 3 into the luggage body 1. This way, the storage space formed by the at least one rear stand-receiving slot 6 is exposed on the rear side 3 to receive the at least one rear kick stand 22. Further, the at least one rear stand-receiving slot 6 is positioned adjacent to the bottom side 5 to position the stored at least one rear kick stand 22 adjacent to the ground when the luggage body 1 is placed on the ground in an upright position. In addition, the rear fixed stand end 23 is positioned within the at least one rear stand-receiving slot 6 so that the rear fixed stand end 23 can be hingedly connected to the luggage body 1. This way, the at least one rear kick stand 22 is secured to the luggage body 1 while enabling the user to manually store or deploy the at least one rear kick stand 22. In other embodiments, different lateral support devices can be implemented on the rear side 3 of the luggage body 1.

In one embodiment, the present invention may further comprise at least one front kick stand 25 that provides lateral support to the luggage body 1 from the front side 2, as can be seen in FIGS. 1 through 22. The at least one front kick stand 25 prevents the luggage body 1 from tilting forward from the load applied to the pull handle 8 when used in the platform configuration. In addition, the luggage body 1 may further comprise at least one front stand-receiving slot 7 that provides a storage space for the at least one front kick stand 25. Similar to the at least one rear kick stand 22, the at least one front kick stand 25 is preferably a lightweight elongated structure that can be manually deployed by the user. So, the at least one front kick stand 25 comprises a front fixed stand end 26 and a front free stand end 27 corresponding to the terminal ends of the elongated structure of the at least one front kick stand 25.

As can be seen in FIGS. 1 through 22, to integrate the at least one front kick stand and the at least one front stand-receiving slot 7 on the luggage body 1, the at least one front stand-receiving slot 7 traverses from the front side 2 into the luggage body 1. This way, the storage space formed by the at least one front stand-receiving slot 7 is exposed on the front side 2 to receive the at least one front kick stand 25. Further, the at least one front stand-receiving slot 7 is centrally positioned in between the top side 4 and the bottom side 5. This way, the at least one rear kick stand 22 central is centered on the front side 2 but also kept close to the ground when the luggage body 1 is placed on the ground in an upright position. In addition, the front fixed stand end 26 is positioned within the at least one front stand-receiving slot 7 so that the front fixed stand end 26 can be hingedly connected to the luggage body 1. This way, the at least one front kick stand 25 is also secured to the luggage body 1 while enabling the user to manually store or deploy the at least one front kick stand 25. In other embodiments, different lateral support devices can be implemented on the front side 2 of the luggage body 1.

In another embodiment, the at least one front kick stand 25 can be replaced with a deployable foot stand 38 that takes less space in front of the luggage body 1 to accommodate the user's feet while using the computing device on the platform configuration of the pull handle 8. As can be seen in FIGS. 23 through 26, the deployable foot stand 38 provides frontal lateral support to the luggage body with a more compact configuration. In addition, the deployable foot stand 38 is designed to be selectively deployed whenever the user wants to use the pull handle 8 in the platform configuration. To do so, the luggage body 1 may further comprise a stand-receiving slot 39 designed to receive the deployable foot stand 38 whenever the user is not using the deployable foot stand 38.

As can be seen in FIGS. 23 through 26, the deployable foot stand 38 can be implemented as follows. The stand-receiving slot 39 is centered on the bottom side 5, adjacent to the front side 2, so that the deployable foot stand 38 provides frontal lateral support to the luggage body 1. In addition, the stand-receiving slot 39 traverses from the bottom side 5 into the luggage body 1 to provide a storage space for the deployable foot stand 38. Further, the deployable foot stand 38 is mounted into the stand-receiving slot 39 so that the deployable foot stand 38 can be selectively deployed and stored away by the user. Thus, the deployable foot stand 38 provides a more compact alternative to the at least one front kick stand 25. In other embodiments, different lateral support devices can be implemented for the present invention.

As can be seen in FIGS. 1 through 7, 17, 18, and 27 through 30, the design of the pull handle 8 can support the portable computing device in different configurations. However, due to the lightweight frame structure of the pull handle 8, the portable computing device may not be stable enough for the user to freely utilize. To provide additional support to the laptop or other portable computing device on the pull handle 8, the present invention may further comprise a laptop tray 28, a first clamp 31, and a second clamp 32. The laptop tray 28 provides a flat solid structure to support the laptop or computing device on the pull handle 8 in the different configurations. The first clamp 31 and the second clamp 32 enable the quick detachable mounting of the laptop tray 28 to the pull handle 8. To match the frame design of the pull handle 8, the first clamp 31 and the second clamp 32 are positioned offset from each other across the laptop tray 28. This way, the first clamp 31 and the second clamp 32 match the arrangement of the first hinged telescopic support 9 and the second hinged telescopic support 10. In addition, the first clamp 31 and the second clamp 32 are connected onto the laptop tray 28 to secure each clamp to the laptop tray 28.

As can be seen in FIGS. 1 through 5, the pull handle 8 and the laptop tray 28 can be arranged into a horizontal platform configuration that supports a portable computing device on top of the converted pull handle 8. In the platform configuration, the laptop tray 28 is positioned parallel to the top side 2 to provide a flat supporting surface for the portable computing device, such as a laptop, to be placed on. In addition, to attach the laptop tray 28 to the pull handle 8 in the platform configuration, the laptop tray 28 is laterally attached to the first hinged telescopic support 9 by the first clamp 31 to secure the laptop tray 28 to the first hinged telescopic support 9. Similarly, the laptop tray 28 is also laterally attached to the second hinged telescopic support 10 by the second clamp 32 to secure the laptop tray 28 to the second hinged telescopic support 10. As a result, a flat elevated surface is formed to support the portable computing device.

As can be seen in FIGS. 1 through 7, 17, 18, and 27 through 30, the size of the portable computing device may be equal to or larger than the width of the pull handle 8, which may require the laptop tray 28 to be large enough to accommodate the portable computing device. However, carrying a large laptop tray 28 while traveling can be inconvenient to the user. So, the laptop tray 28 can be designed as an expandable structure that can be arranged into an expanded configuration to accommodate the size of the laptop or into a collapsed configuration for easy storage. To do so, the laptop tray 28 may comprise a first tray portion 29 and a second tray portion 30 corresponding to the two telescopic portions of the laptop tray 28 that can be expanded or collapsed. The first tray portion 29 and the second tray portion 30 are telescopically engaged to each other to enable the selective expansion of the laptop tray 28. Further, the first clamp 31 is attached onto the first tray portion 29, offset from the second tray portion 30, to secure the first clamp 31 to the first tray portion 29. Similarly, the second clamp 32 is attached onto the second tray portion 30, offset from the first tray portion 29, to secure the second clamp 32 to the second tray portion 30. This way, in the collapsed configuration, the laptop tray 28 has an overall smaller size that can be more easily stored away. However, in the expanded configuration, the laptop tray 28 can accommodate the portable computing device on the pull handle 8 in the platform configuration. In other embodiments, different size-adjustment mechanisms can be implemented for the laptop tray 28.

As can be seen in FIGS. 1 through 7 and 27 through 30, the laptop tray 28 can also be provided with lateral features that restrict the movement of the laptop or computing device placed on the laptop tray 28. For example, the present invention may further comprise at least one tray ledge 37 that prevents the laptop or computing device from falling off the laptop tray 28. In one embodiment, the at least one tray ledge 37 is peripherally connected onto the laptop tray 28, opposite to the first clamp 31 and the second clamp 32, to incorporate the at least one tray ledge 37 on the laptop tray. In addition, the at least one tray ledge 37 can be positioned along the second clamp 32 so that the at least one tray ledge 37 is provided on one side of the laptop tray 37. However, additional tray ledges can be provided around the laptop tray 37.

Figure 6:
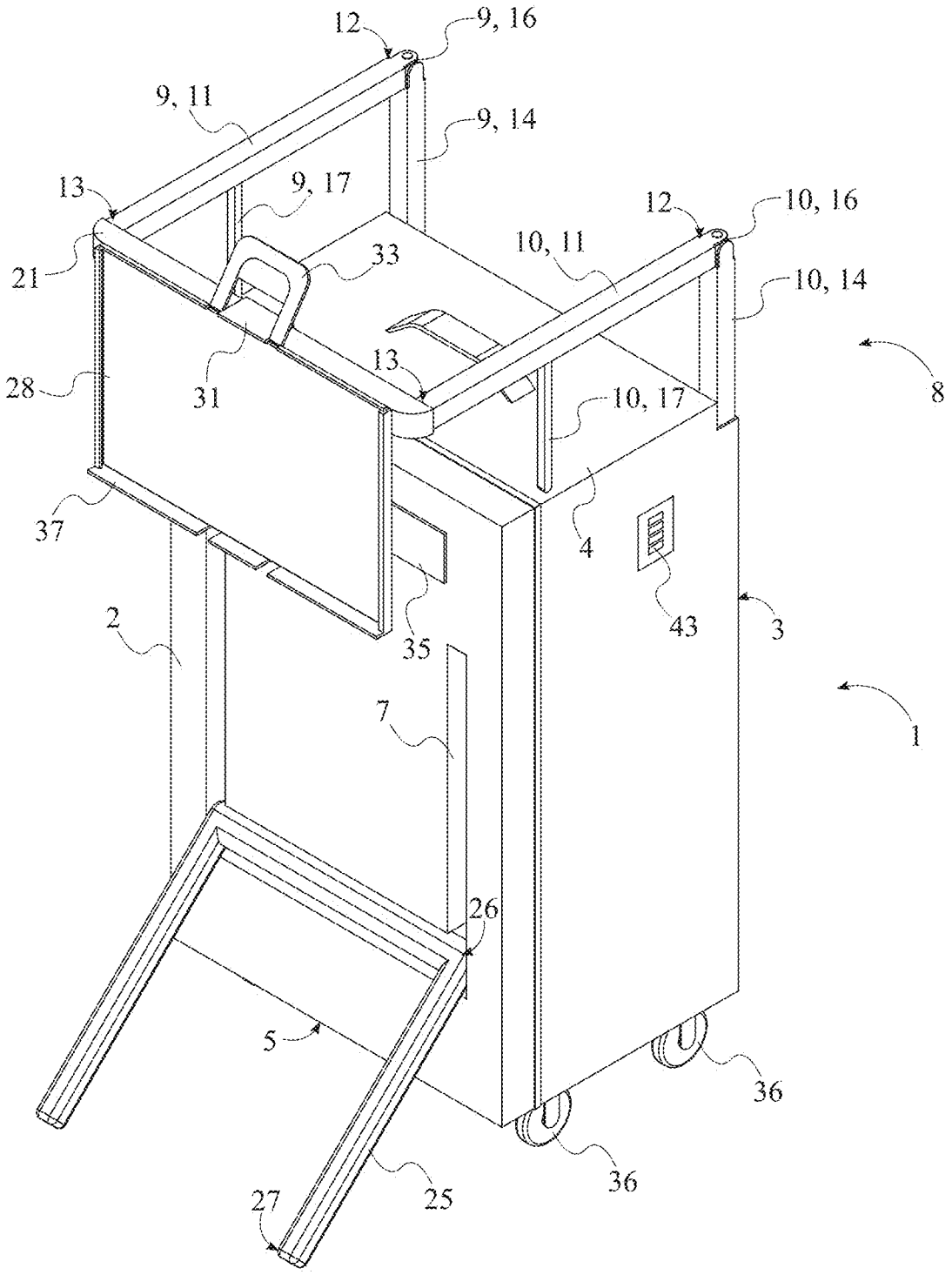
FIG. 6 is a top-front-left perspective view of the present invention, wherein the pull handle and the laptop tray are shown in a first holder configuration, wherein the front kick stand, the rear kick stand, and the kickout support rods are shown deployed, and wherein the laptop tray is shown hanging from the pull handle.
Figure 7:
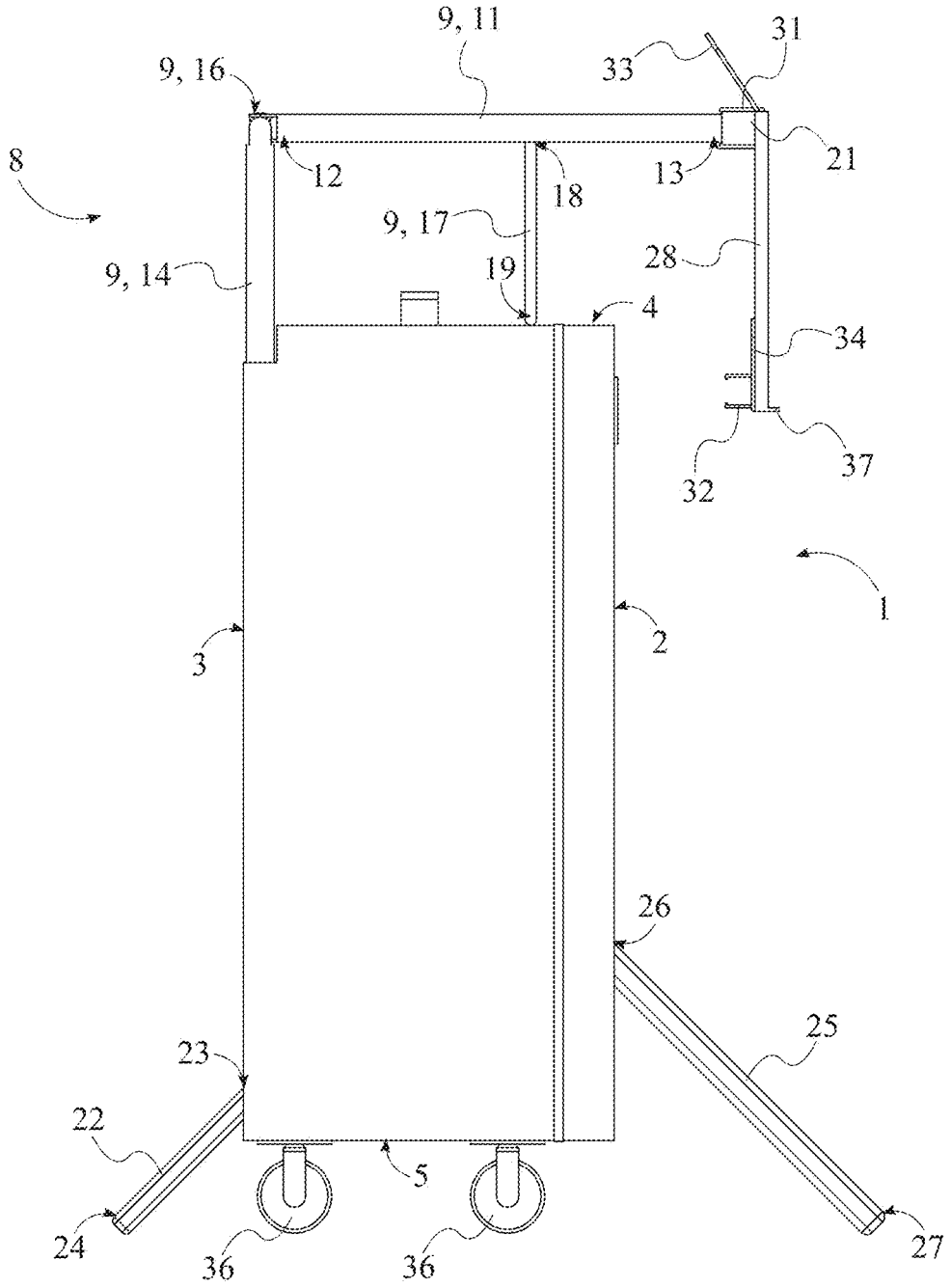
FIG. 7 is a right-side view thereof.
Figure 8:
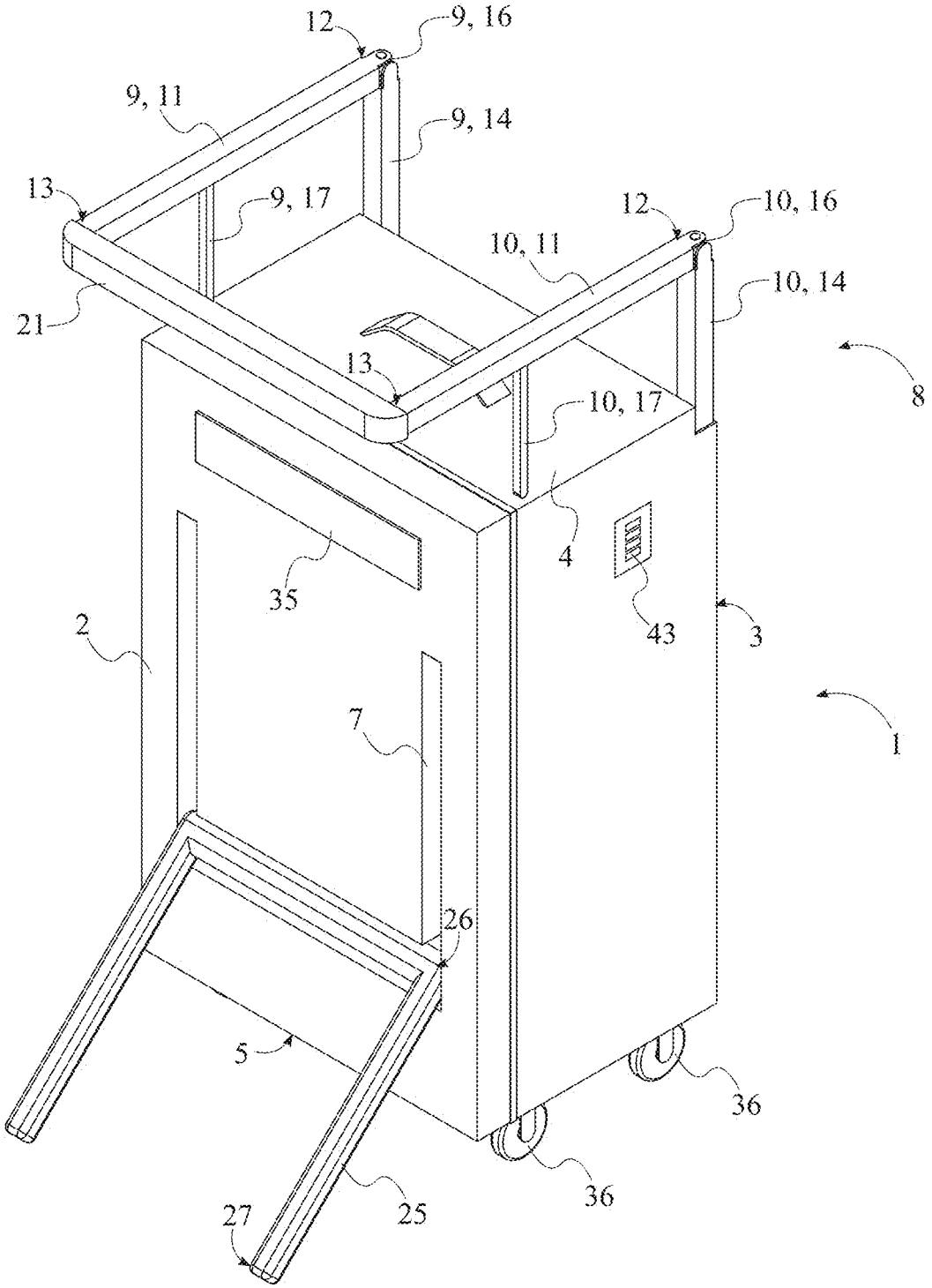
FIG. 8 is a top-front-left perspective view of the present invention, wherein the front kick stand, the rear kick stand, and the kickout support rods are shown deployed without the laptop tray.
Figure 9:
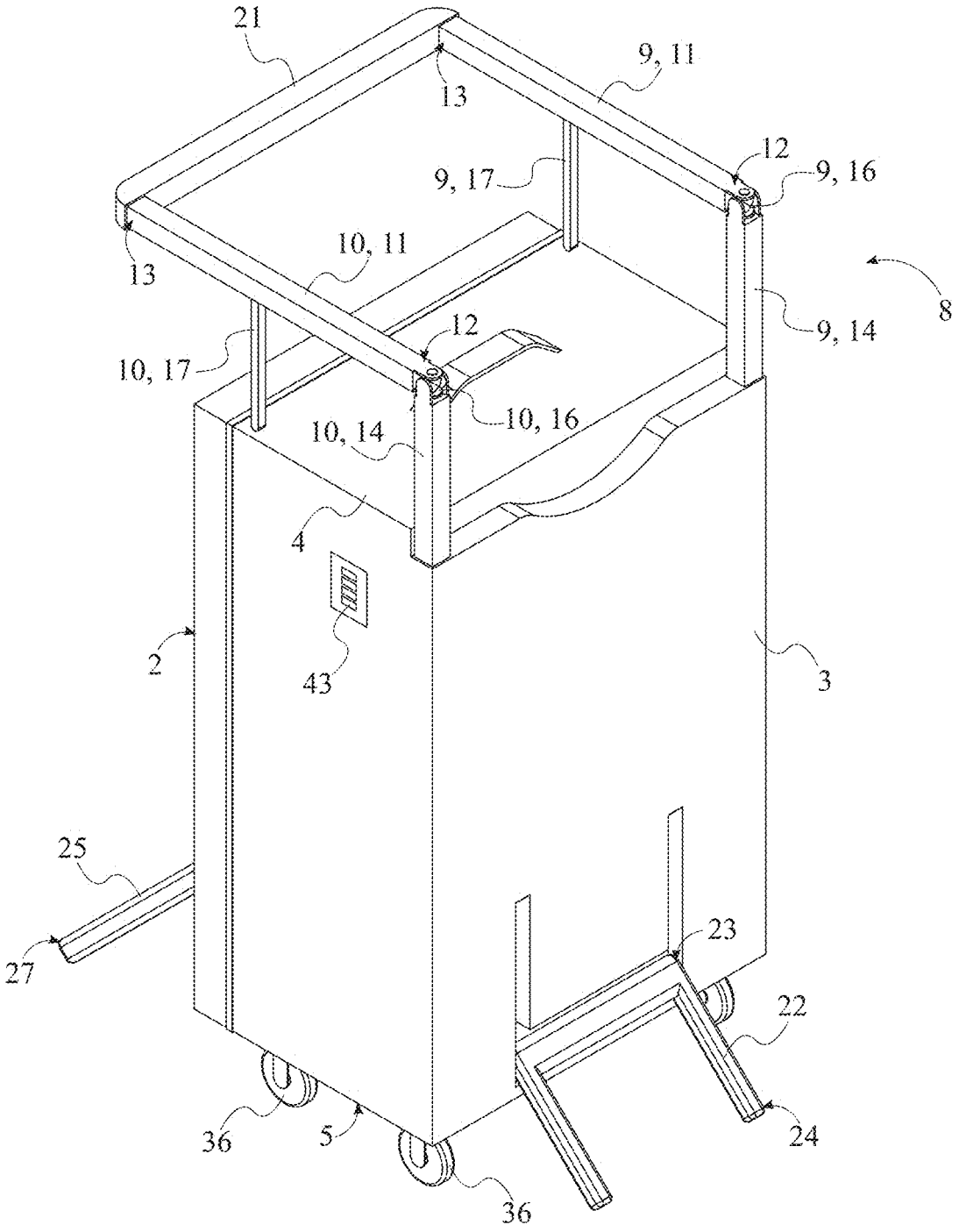
FIG. 9 is a top-rear-left perspective view thereof.
Figure 10:
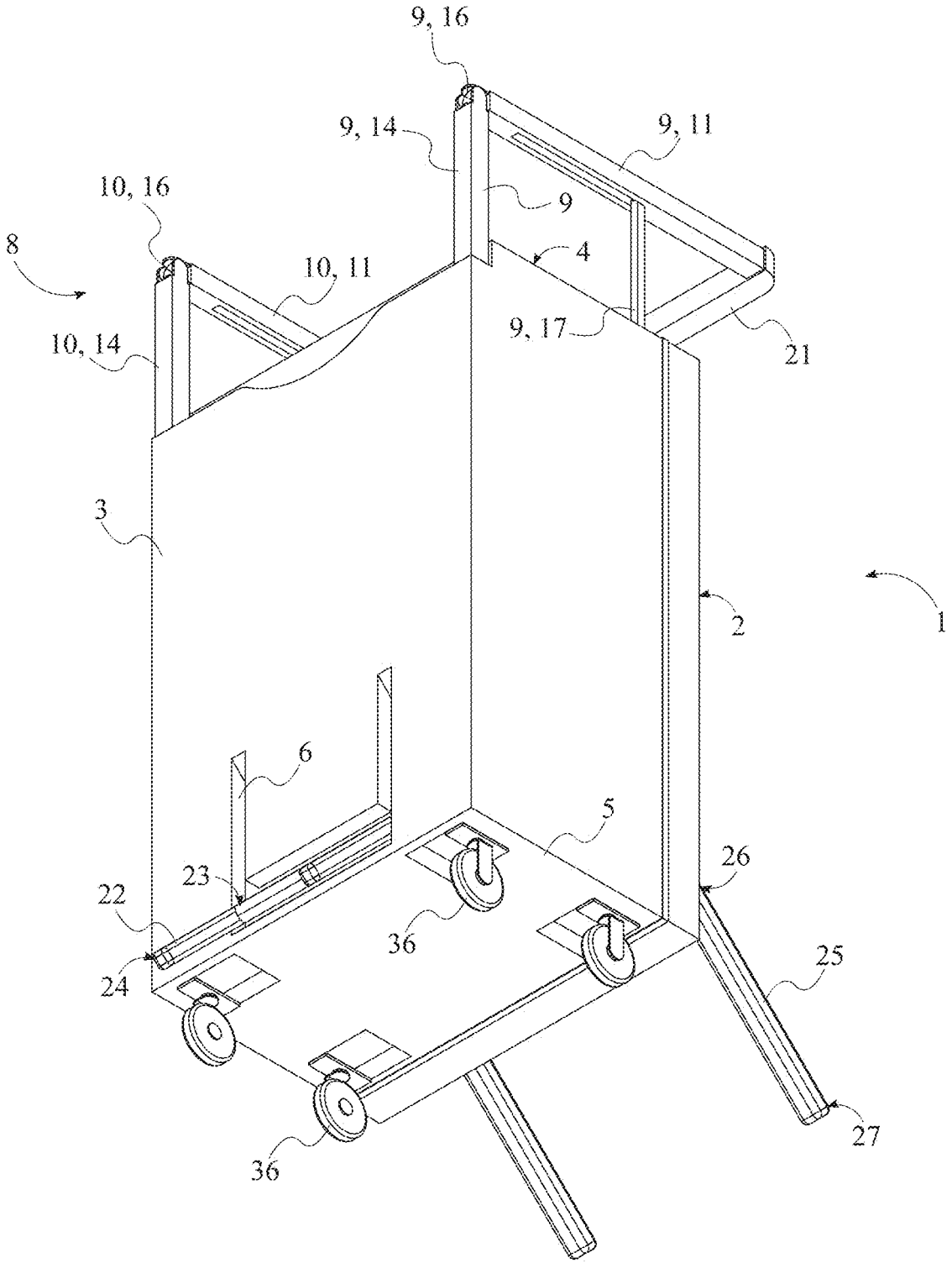
FIG. 10 is a bottom-rear-right perspective view thereof.
Figure 11:
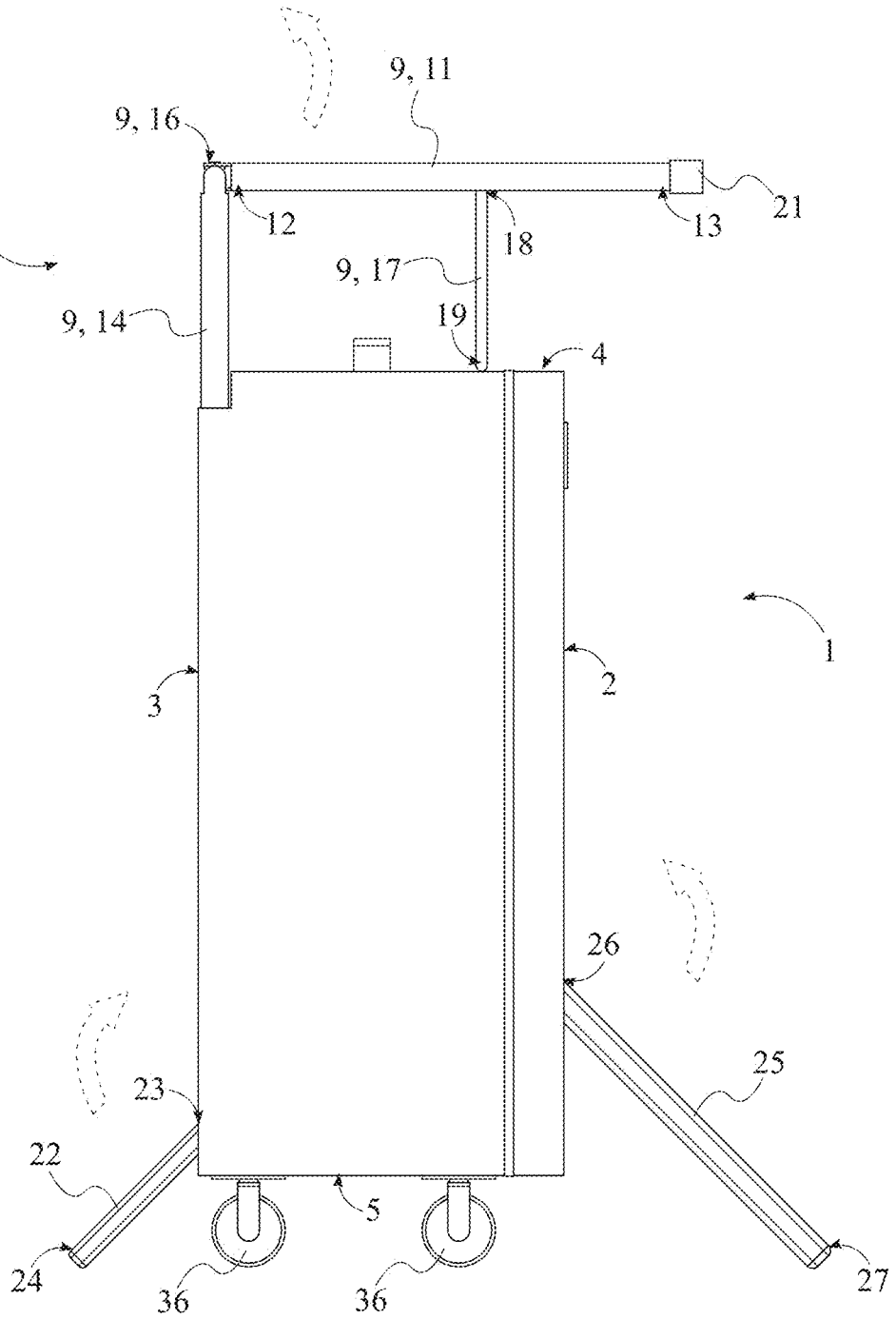
FIG. 11 is a right-side view thereof.
Figure 12:
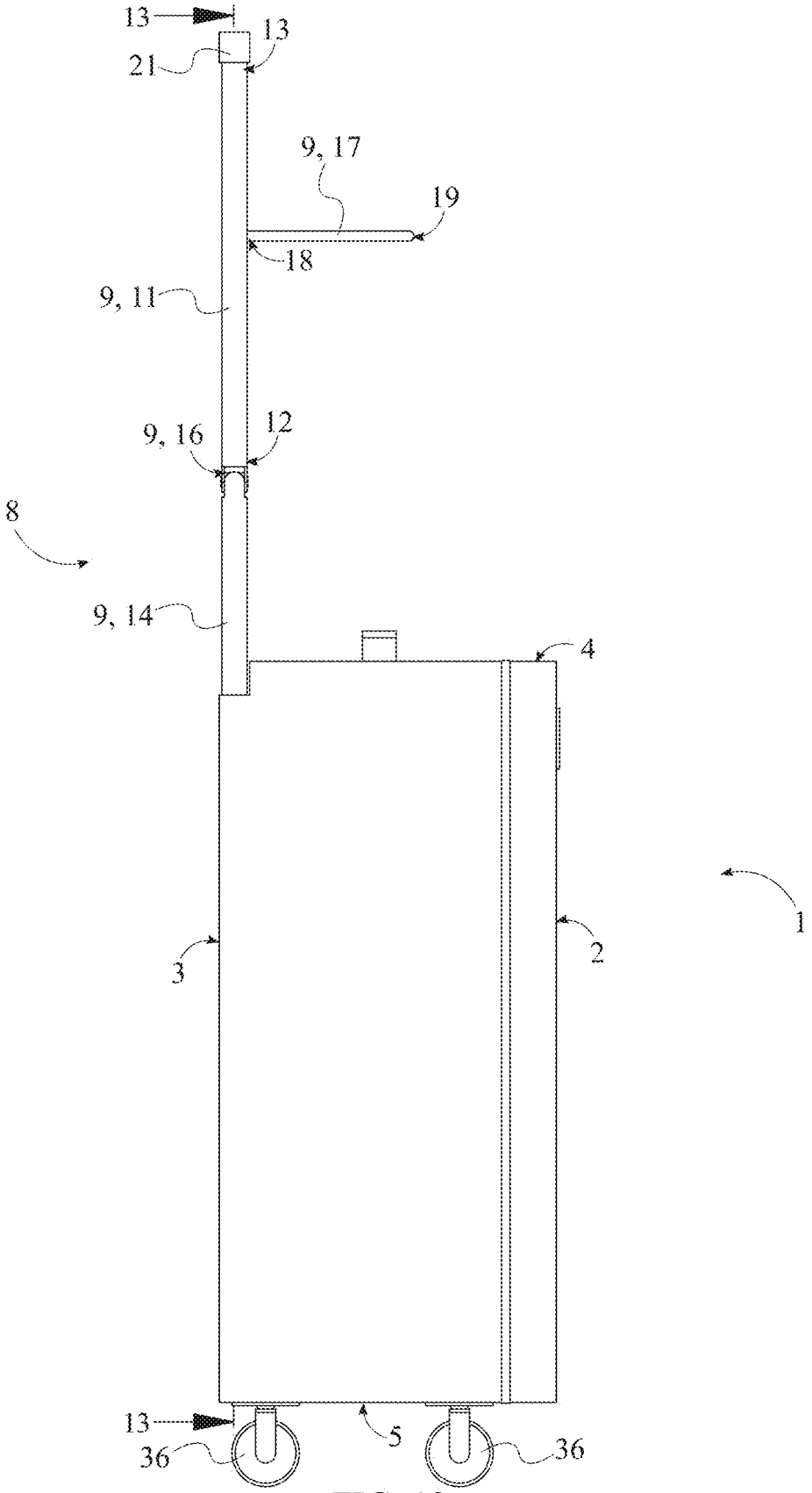
FIG. 12 is a right-side view of the present invention, wherein the front kick stand and the rear kick stand are shown stored away, and wherein the kickout support rods are shown deployed.
Figure 13:
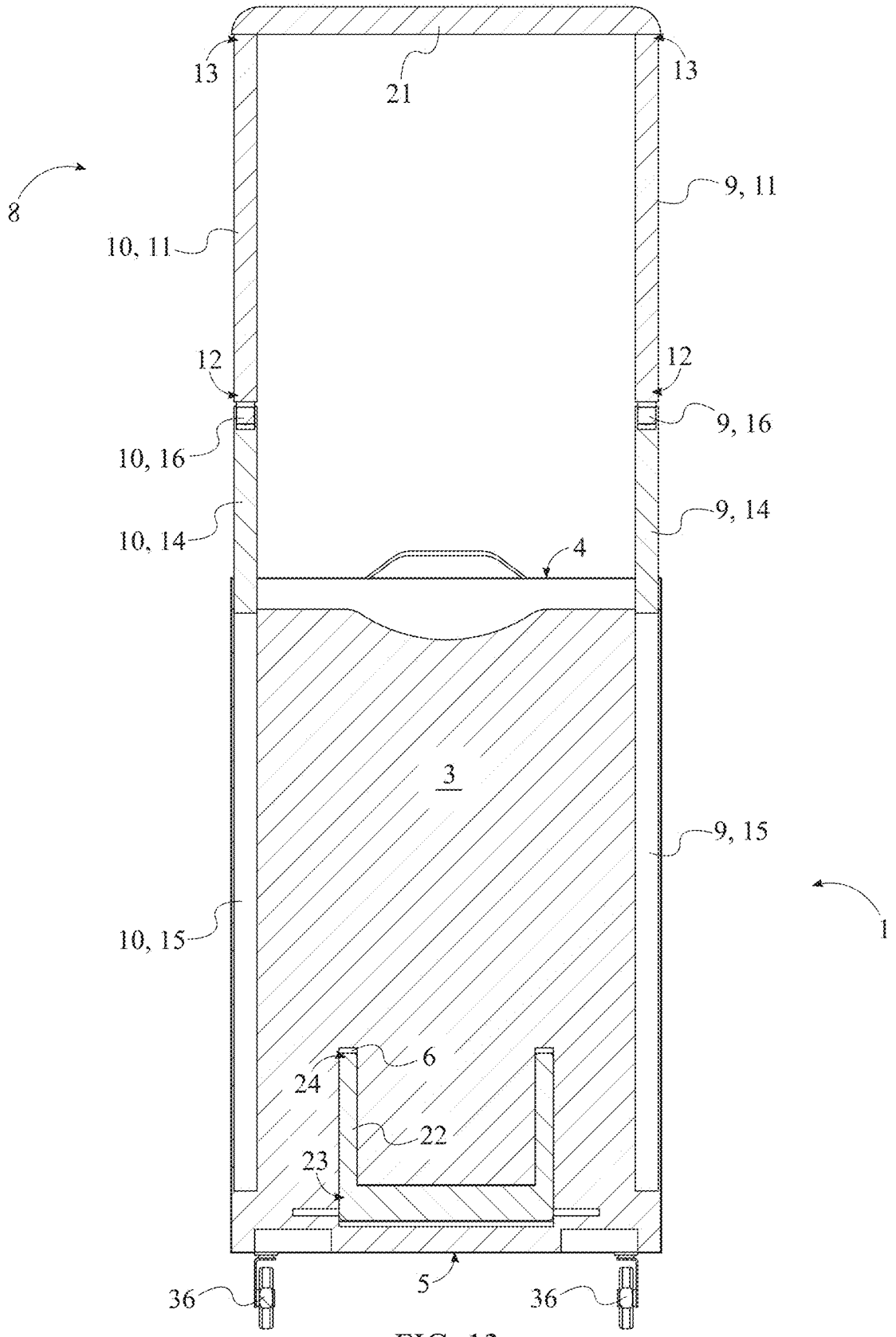
FIG. 13 is a vertical cross-sectional view of the present invention taken along line 13-13 shown in FIG. 12.
Figure 14:
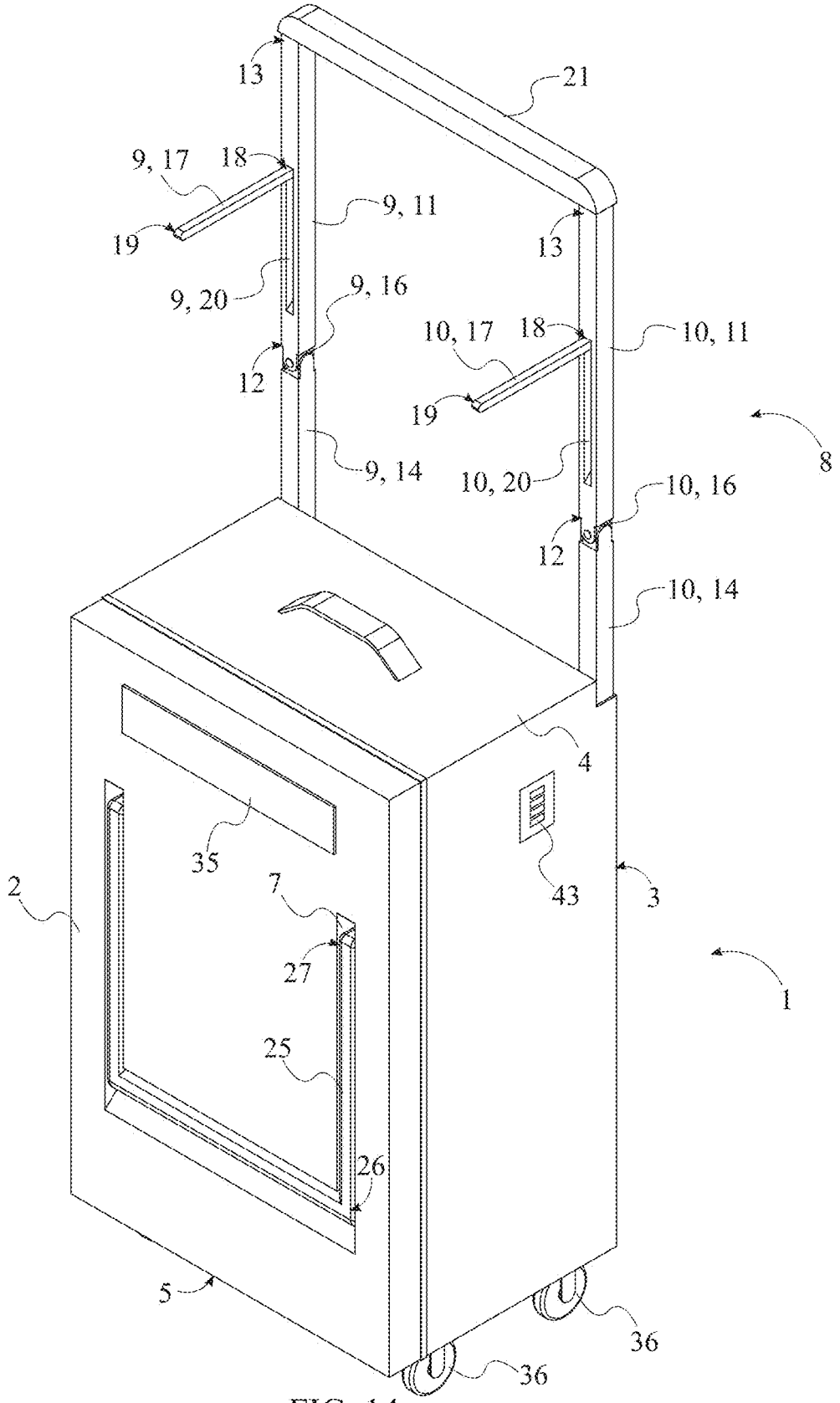
FIG. 14 is a top-front-left perspective view thereof.
Figure 15:
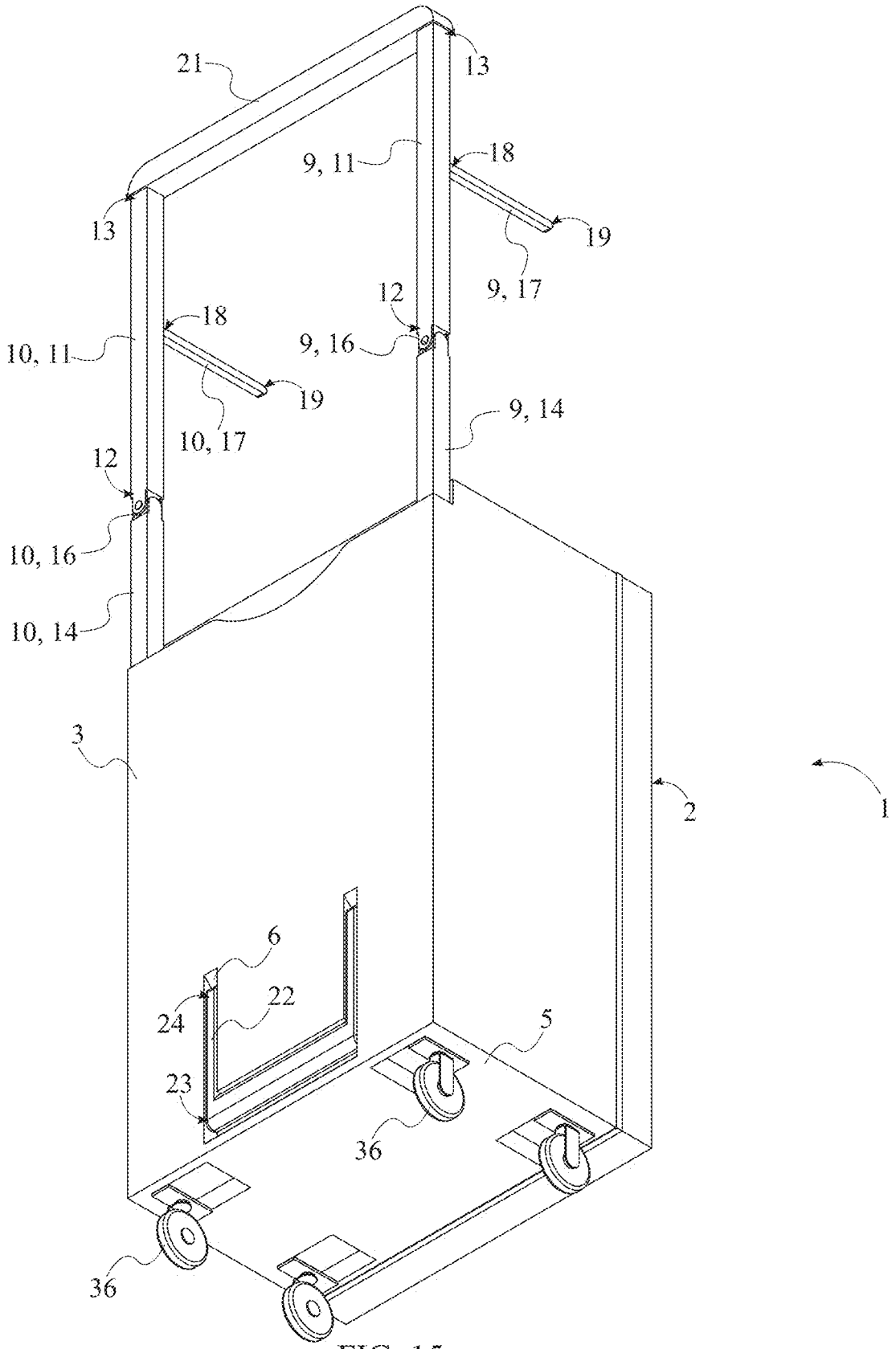
FIG. 15 is a bottom-rear-right perspective view thereof.
Figure 16:
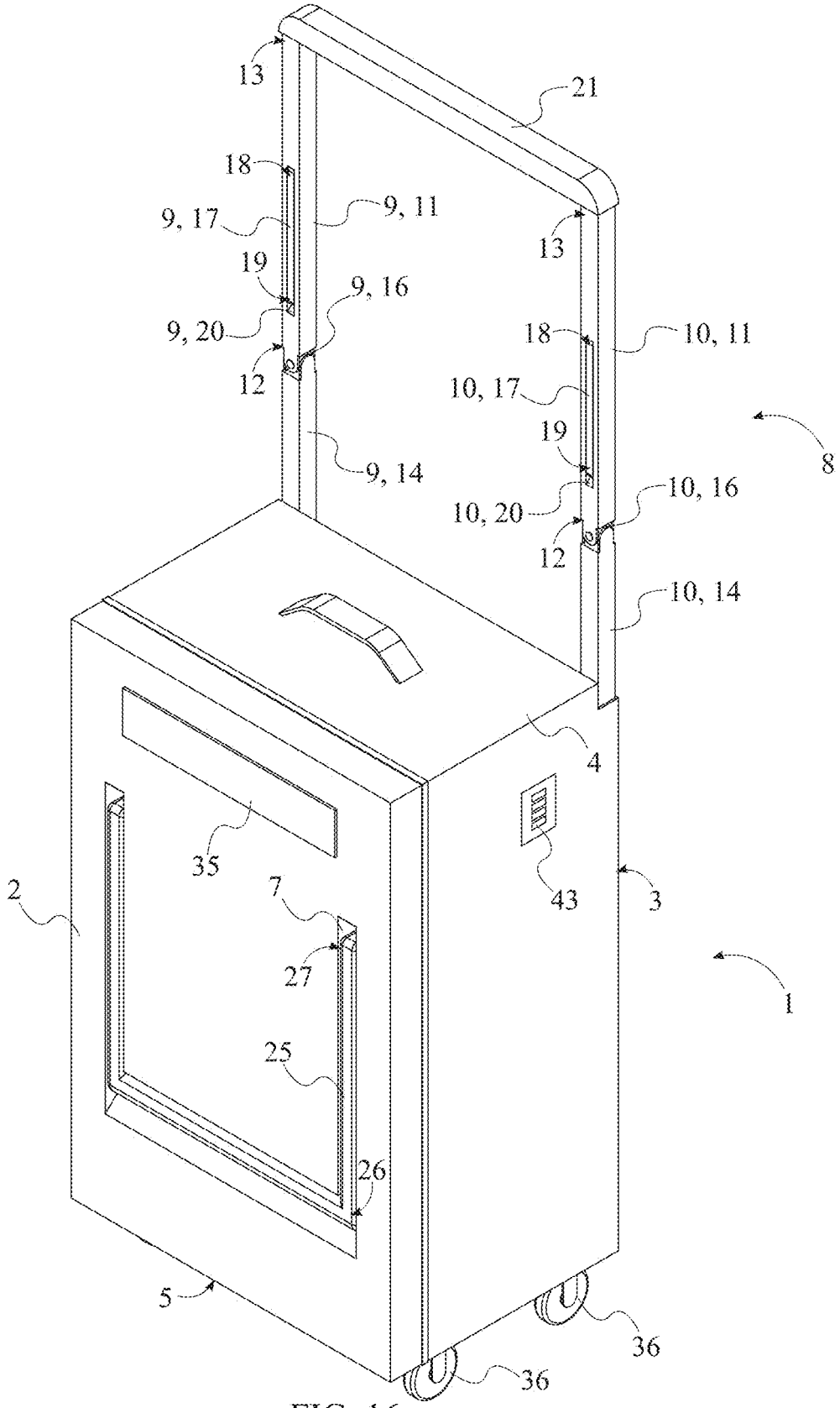
FIG. 16 is a top-front-left perspective view of the present invention, wherein the front kick stand, the rear kick stand, and the kickout support rods are shown stored away, and wherein the pull handle is shown deployed.

The at least one tray ledge 37 enables the laptop tray 28 to support the portable computing device in different orientations. As can be seen in FIGS. 6 and 7, the laptop tray 28 and the pull handle 8 can be arranged into a first holder configuration that holds the computing device in a vertical orientation. For example, the first holder configuration can be used to hold a tablet or smartphone vertically for the user to comfortably watch media while sitting down. To do so, the laptop tray 28 is positioned perpendicular to the top side 4 to support the retained computing device in a vertical orientation. In addition, the laptop tray 28 is laterally attached to the crossbar 21 by the first clamp 31 so that the laptop tray 28 hangs vertically from the pull handle 8. The at least one tray ledge 37 prevents the retained computing device from falling off the laptop tray 28.

Figure 17:
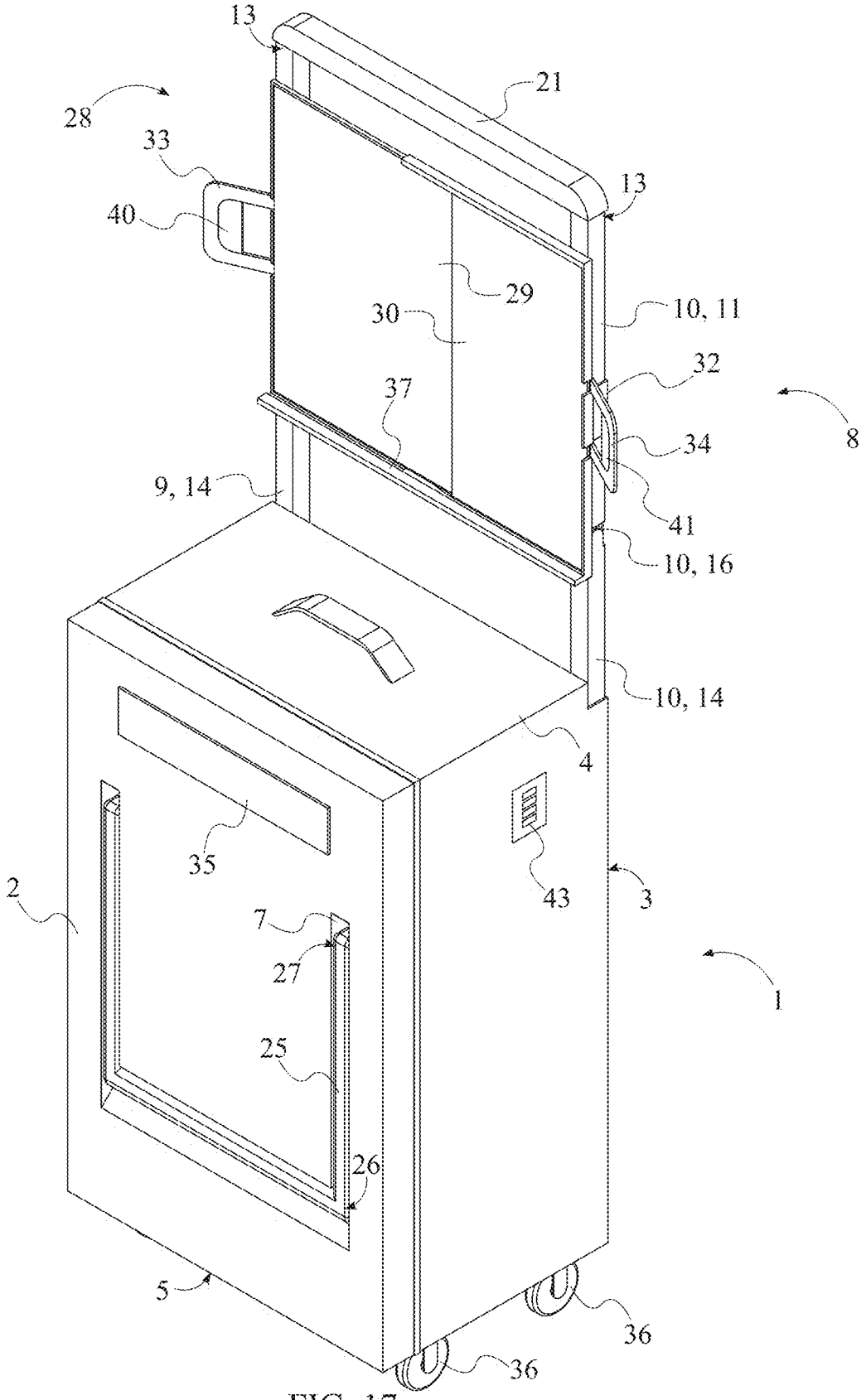
FIG. 17 is a top-front-left perspective view of the present invention, wherein the pull handle and the laptop tray are shown in a second holder configuration, wherein the rear kick stand is shown deployed, and wherein the laptop tray is shown attached onto the vertical pull handle.
Figure 18:
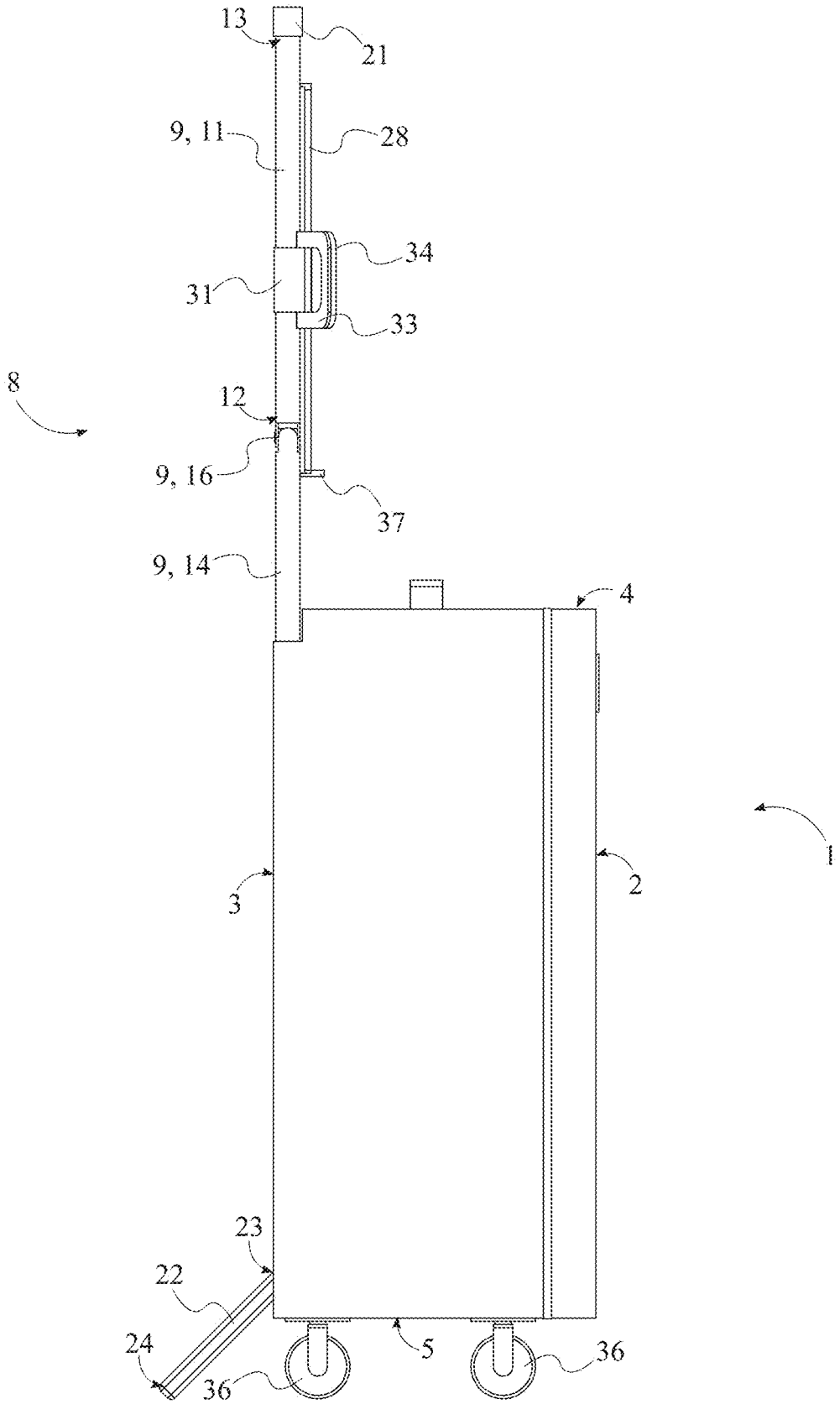
FIG. 18 is a right-side view thereof.

As can be seen in FIGS. 17 and 18, in another embodiment, the at least one tray ledge 37 can be positioned in between the first clap 31 and the second clamp 32 so that the at least one tray ledge 37 is provided on a lengthwise side of the laptop tray 37. This allows the laptop tray 28 to retain portable computer devices in different configurations. For example, the laptop tray 28 and the pull handle 8 can be arranged into a second holder configuration that also holds the computing device in a vertical orientation. In the second holder configuration, the computing device can be retained higher to allow the user to view the display of the computing device at a higher elevation. To do so, the laptop tray 28 is positioned perpendicular to the top side 4 to support the retained computing device in a vertical orientation. In addition, the laptop tray 28 is laterally attached to the first hinged telescopic support 9 by the first clamp 31 to secure the laptop tray 28. Similarly, the laptop tray 28 is also laterally attached to the second hinged telescopic support 10 by the second clamp 32 to secure the laptop tray 28. This way, the retained computing device is held above the top side 4 to elevate the display of the computing device. In other embodiments, the laptop tray 28 and the pull handle 8 can be arranged into different configurations to support the desired computing device in different orientations or positions.

As can be seen in FIGS. 1 through 7 and 25 through 28, to help the user manipulate the laptop tray 28, the present invention may further comprise a first retractable handle 33 and a second retractable handle 34. The first retractable handle 33 and the second retractable handle 34 enable the user to manually change the configuration of the laptop tray 28. The first retractable handle 33 and the second retractable handle 34 also enable the user to manipulate the laptop tray 28 when not mounted to the pull handle 8 in the platform configuration. To do so, the first retractable handle 33 is peripherally connected to the laptop tray 28 to preferably secure the first retractable handle 33 to the first tray portion 29. Similarly, the second retractable handle 34 is peripherally connected to the laptop tray 28, opposite to the first retractable handle 33, to preferably secure the second retractable handle 34 to the second tray portion 30.

This way, the user can change the configuration of the tray handle using the first retractable handle 33 and the second retractable handle 34. In other embodiments, additional features can be implemented into the laptop tray 28 to improve the functionality of the laptop tray 28.

In some embodiments, the laptop tray 28 can be designed to support external accessories such as a clip-on desk lamp with a flexible gooseneck arm that can illuminate the laptop tray 28 and the devices placed on the laptop tray 28. However, in other embodiments, illumination features can be implemented into the laptop tray 28 to reduce the number of devices the user must carry while traveling. As can be seen in FIGS. 25 through 28, the present invention may further comprise a first light source 40 and a second light source 41 that are incorporated into the laptop tray 28 to illuminate the laptop tray 28 and any devices placed on the laptop tray 28. To do so, the first light source 40 is integrated into the first retractable handle 33 to incorporate the first light source 40 into the first retractable handle 33. This way, the user can change the position of the first retractable handle 33 to selectively illuminate the surroundings. Likewise, the second light source 41 is integrated into the second retractable handle 34. This way, the user can also change the position of the second retractable handle 34 to selectively illuminate the surroundings. Both the first light source 40 and the second light source 41 can be battery-powered light sources that can be recharged from an external power source using rechargeable batteries or by utilizing disposable batteries. Alternatively, the first light source 40 and the second light source 41 can also be powered from a power source provided within the luggage body 1.

Figure 19:
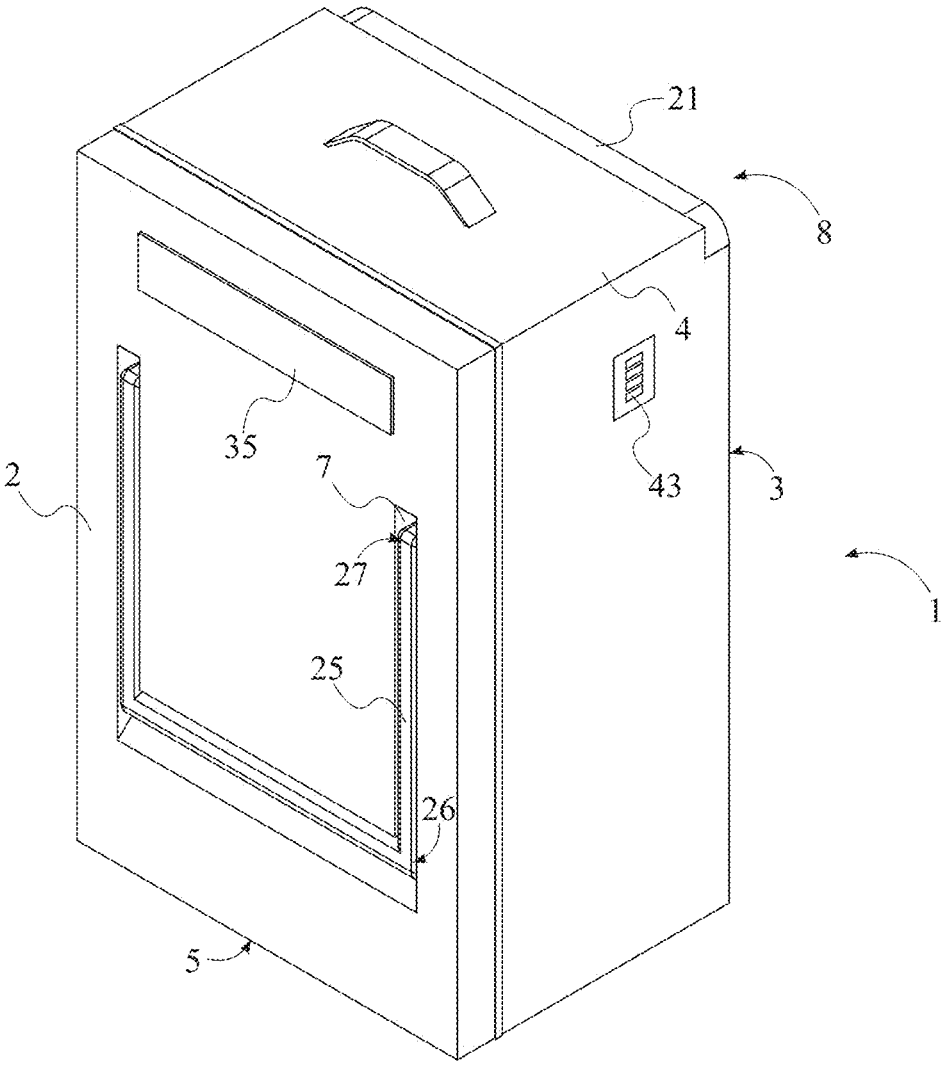
FIG. 19 is a top-front-left perspective view of the present invention, wherein the pull handle and caster wheels of the present invention are shown stored away for easier storage of the present invention.
Figure 20:
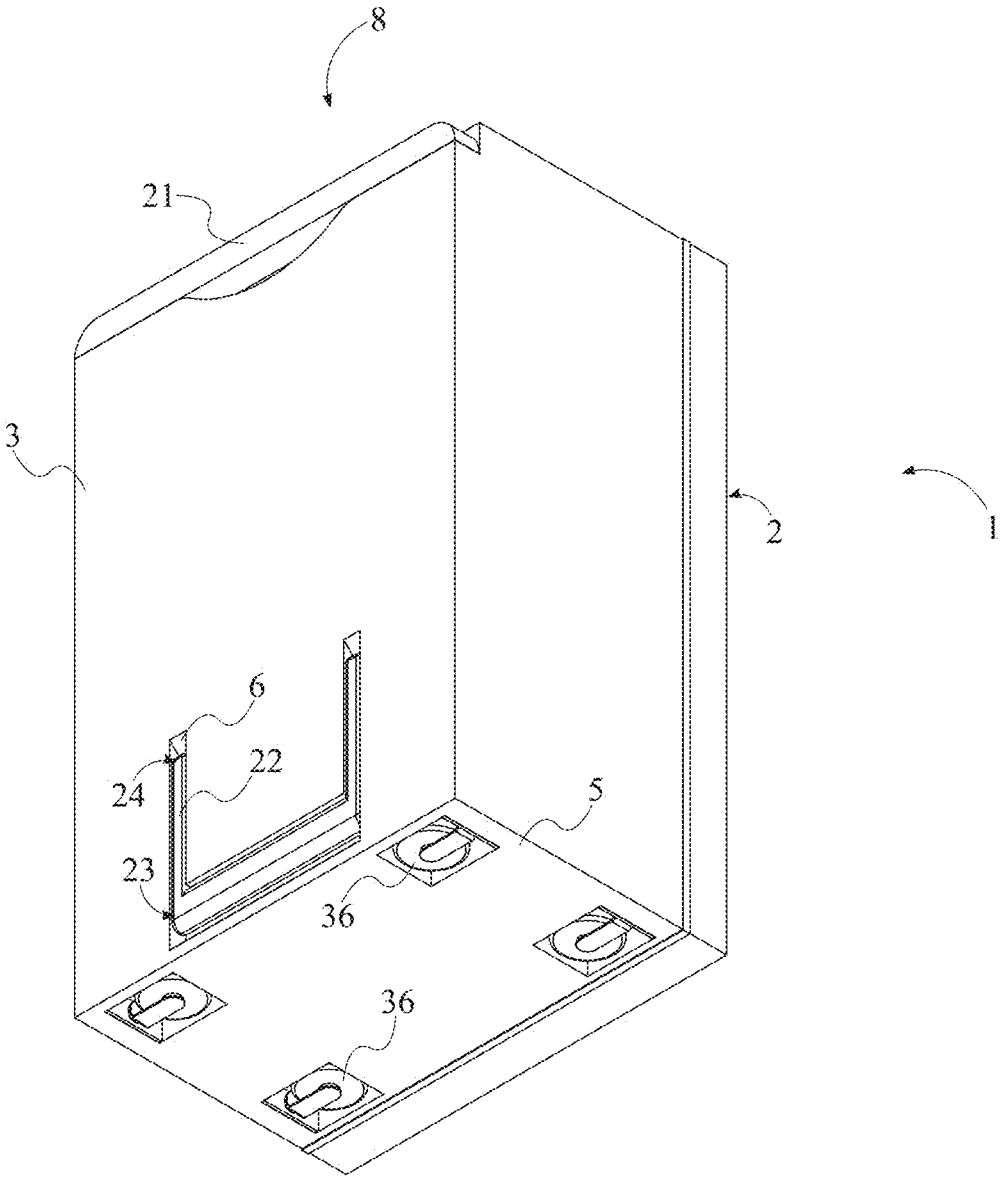
FIG. 20 is a bottom-rear-right perspective view thereof.
Figure 21:
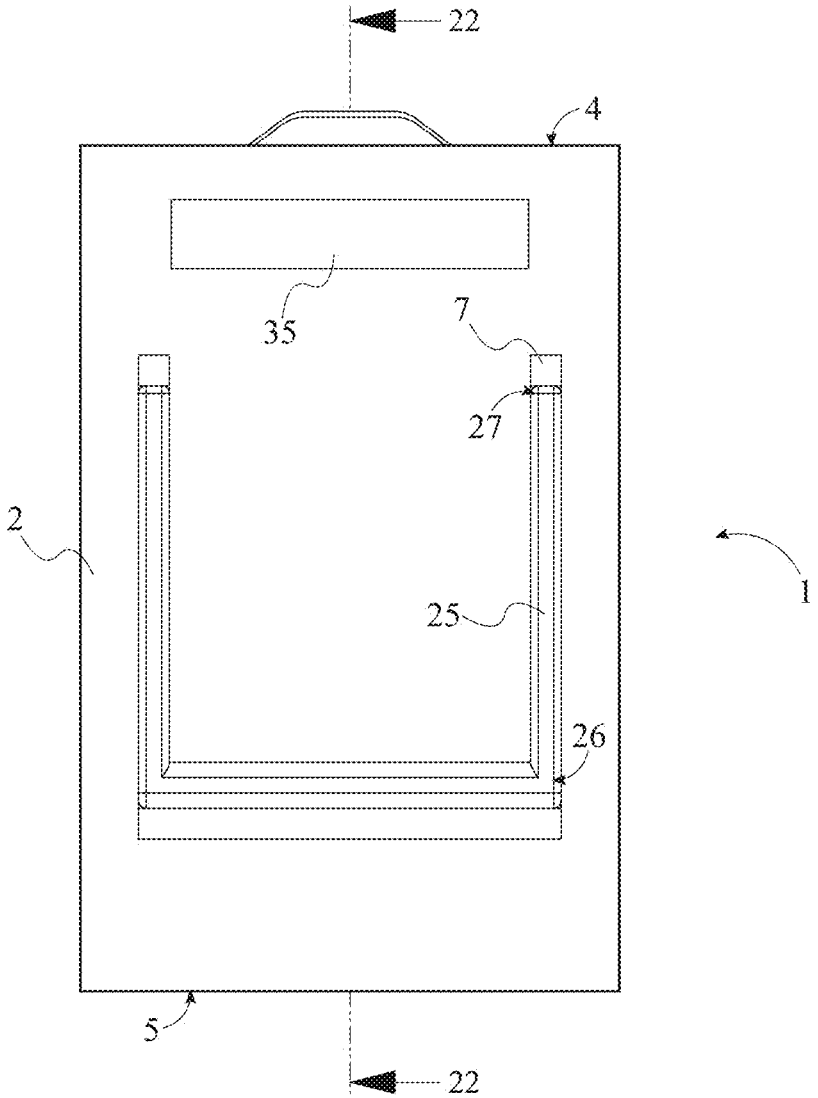
FIG. 21 is a front-side view thereof.
Figure 22:
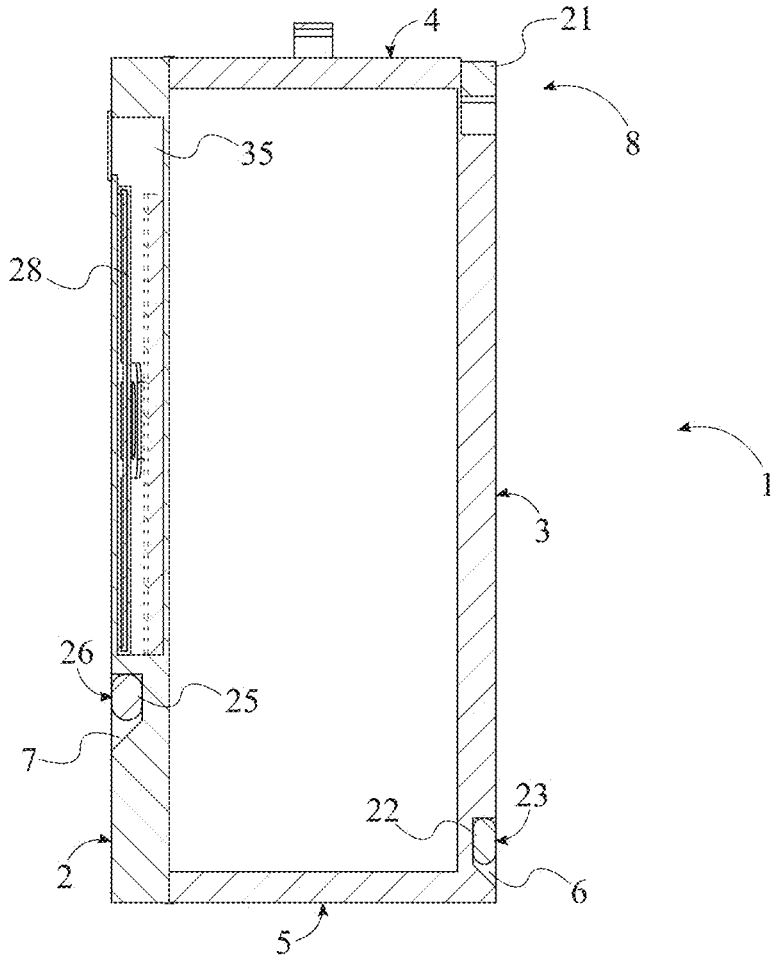
FIG. 22 is a vertical cross-sectional view of the present invention taken along line 22-22 shown in FIG. 21.
Figure 23:
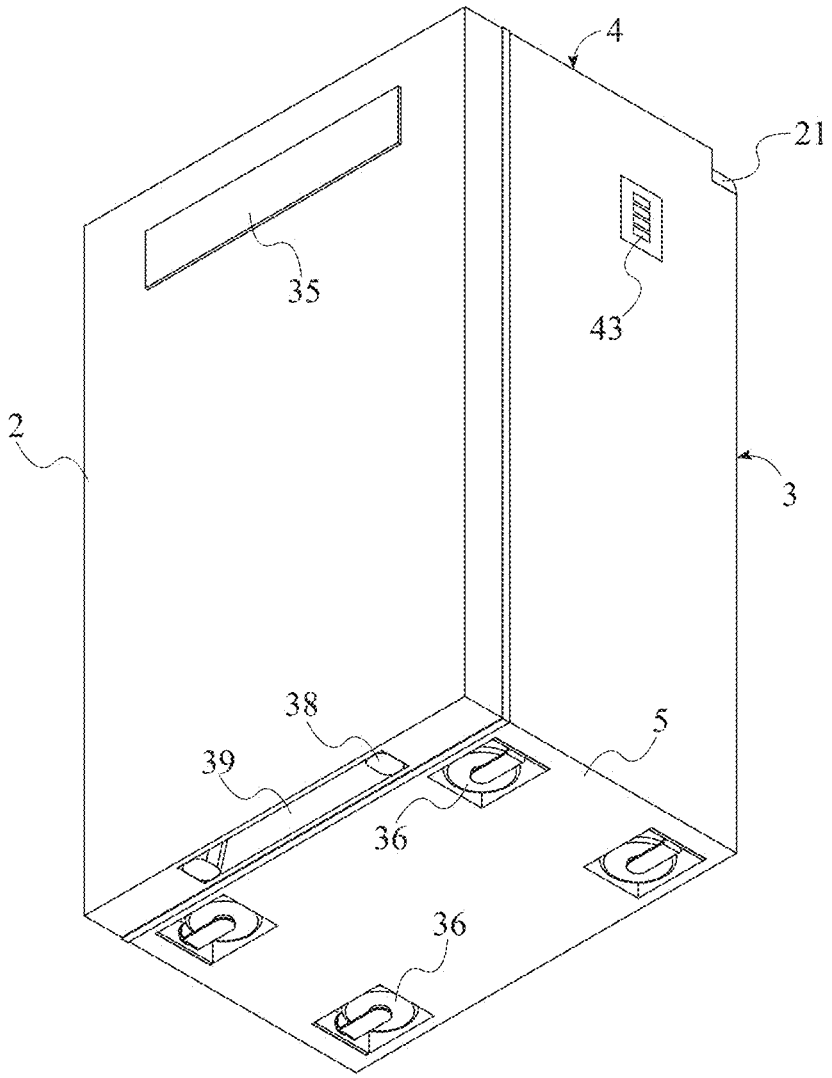
FIG. 23 is a bottom-front-left perspective view of the present invention, wherein the present invention is shown with a deployable foot stand, and wherein the deployable foot stand is shown stored away in a stand-receiving slot.
Figure 24:
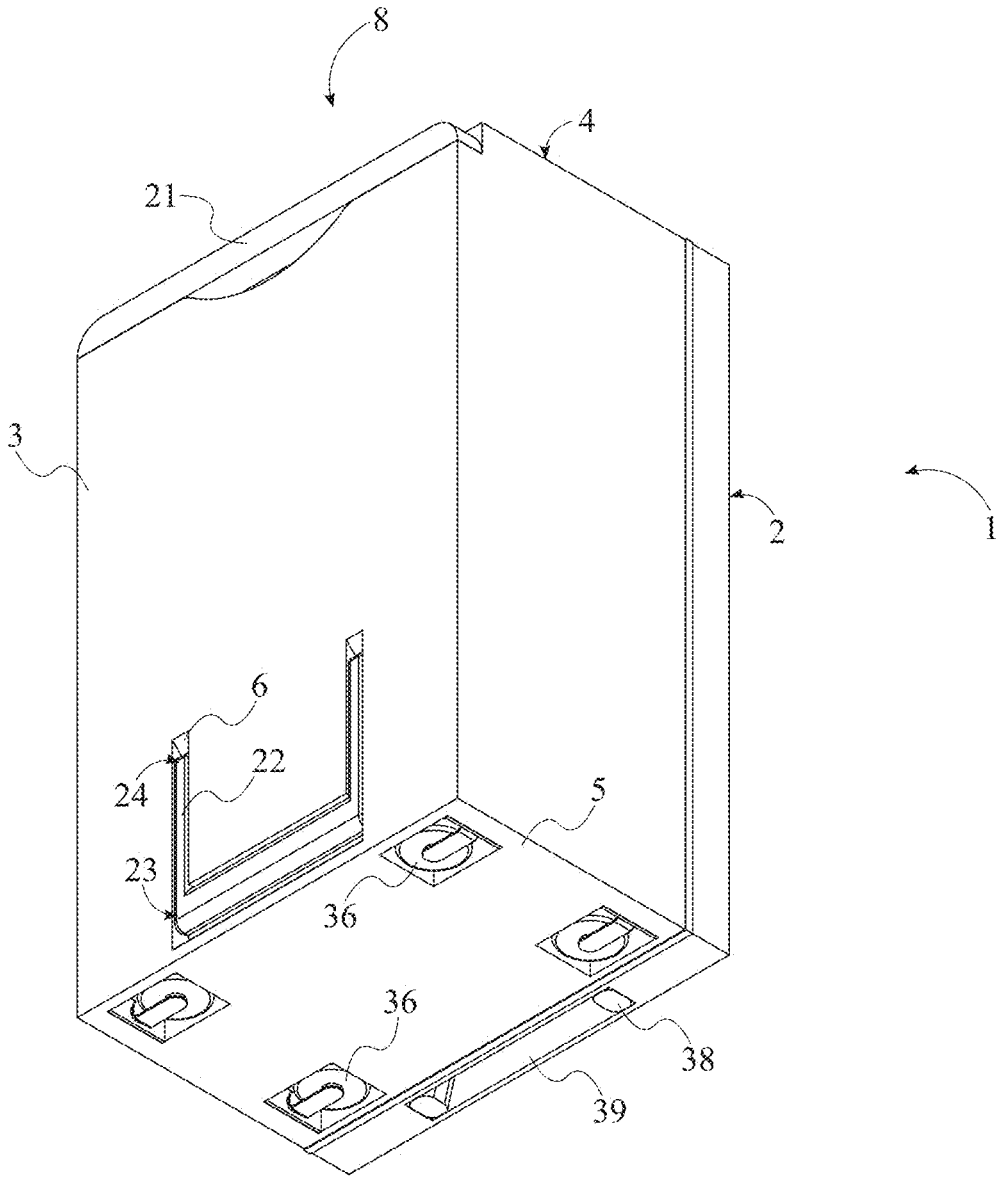
FIG. 24 is a bottom-rear-left perspective view thereof.
Figure 25:
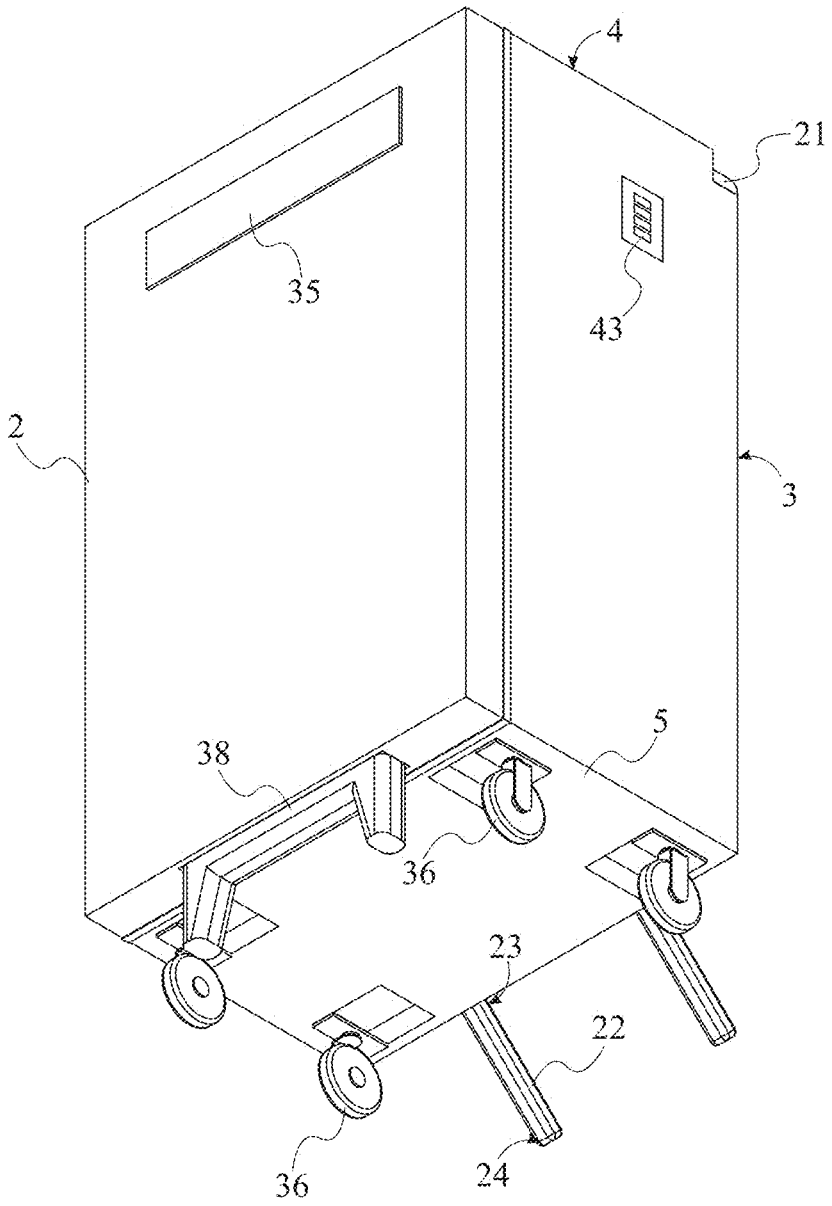
FIG. 25 is a bottom-front-left perspective view of the present invention, wherein the deployable foot stand and the rear kick stand are shown deployed.
Figure 26:
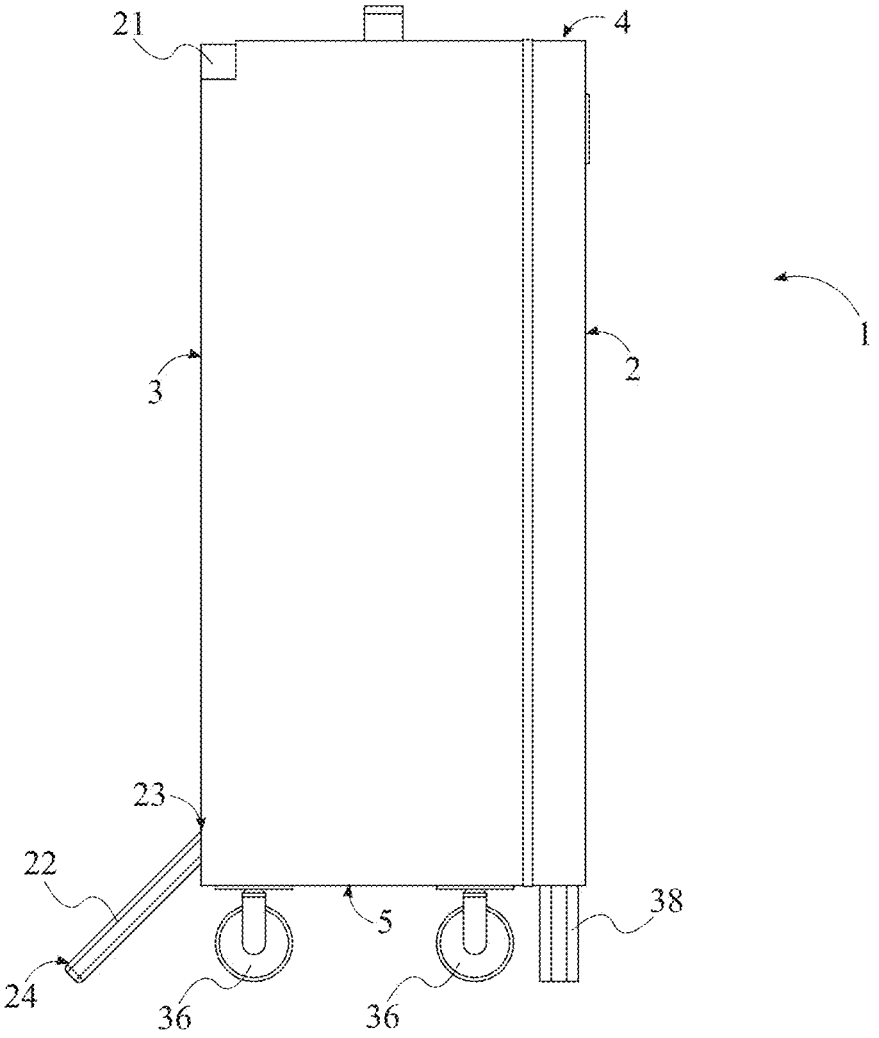
FIG. 26 is a right-side view thereof.
Figure 27:
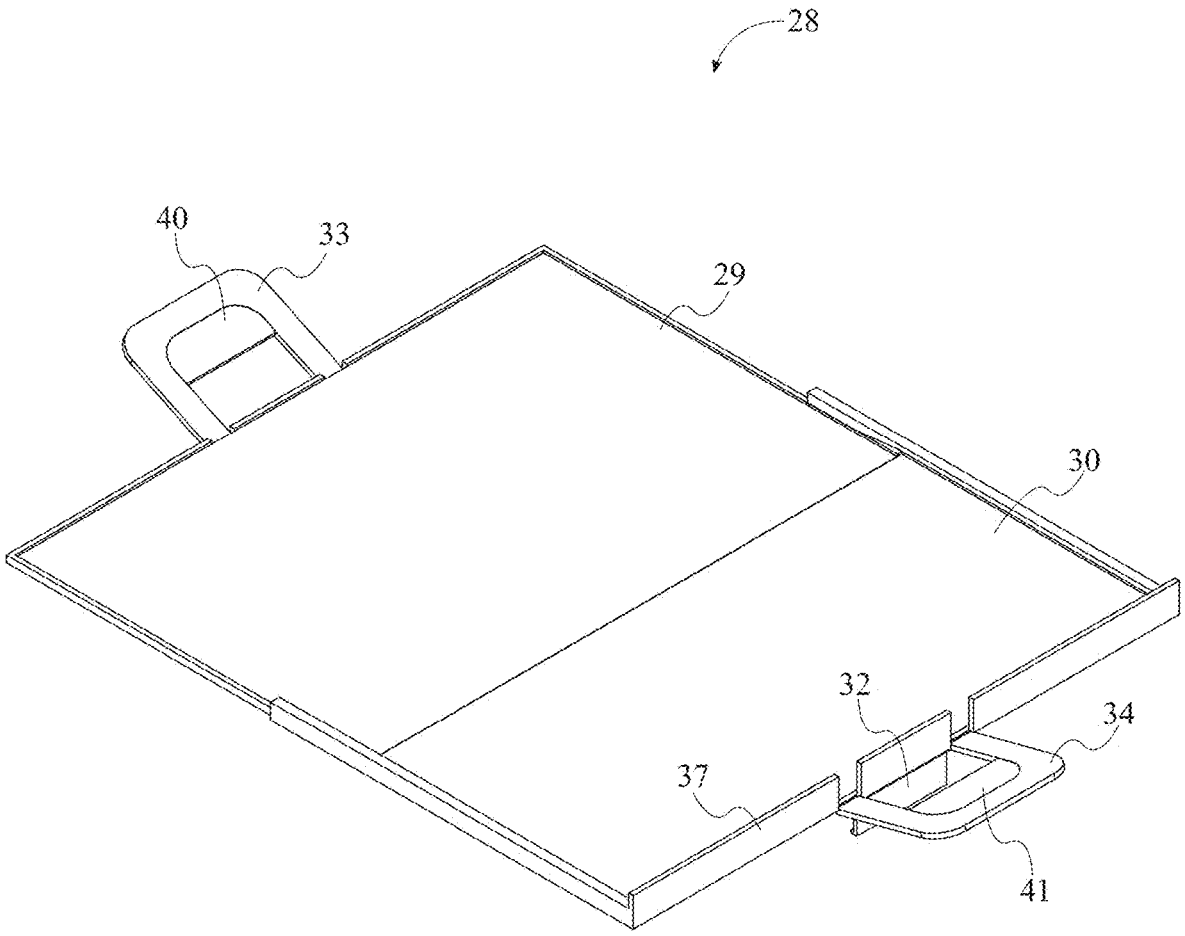
FIG. 27 is a top-front-left perspective view of the laptop tray of the present invention, wherein the laptop tray is shown in an expanded configuration.
Figure 28:
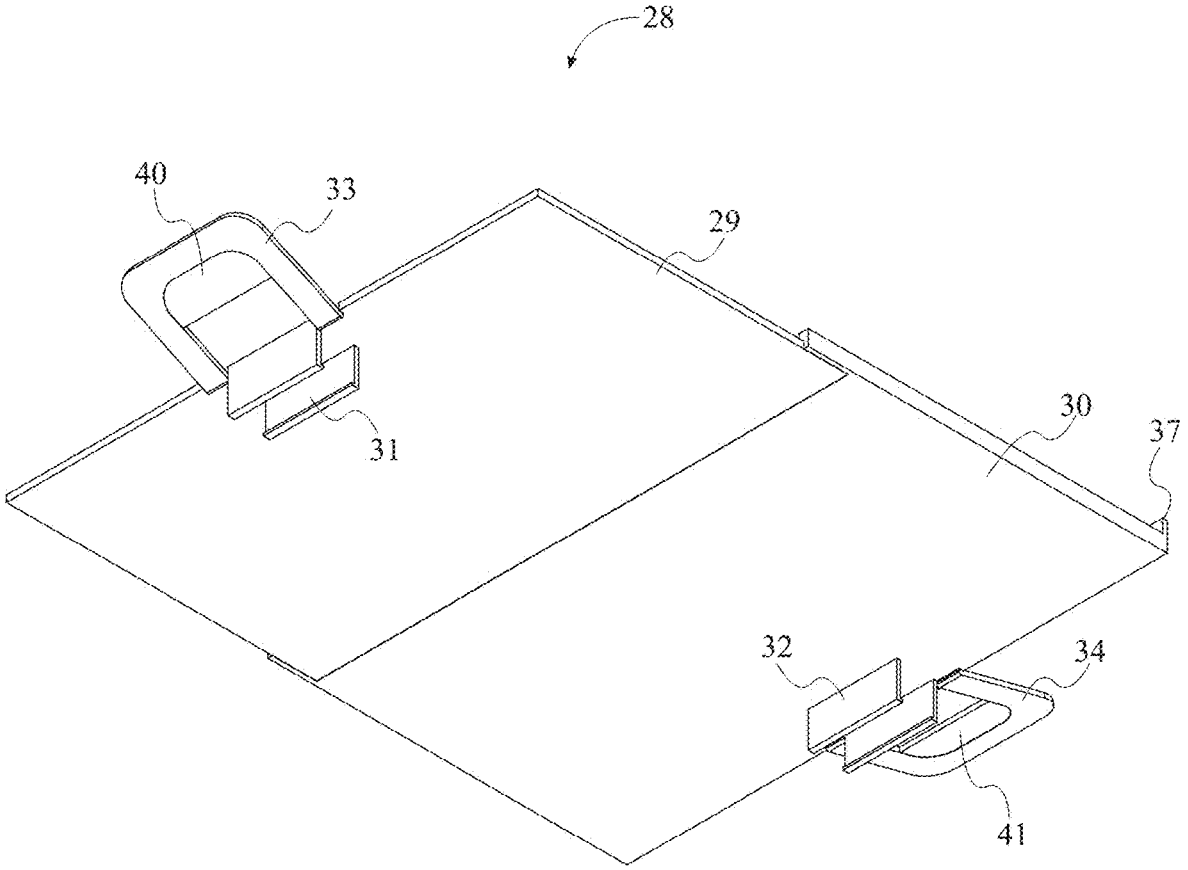
FIG. 28 is a bottom-front-right perspective view thereof.
Figure 29:
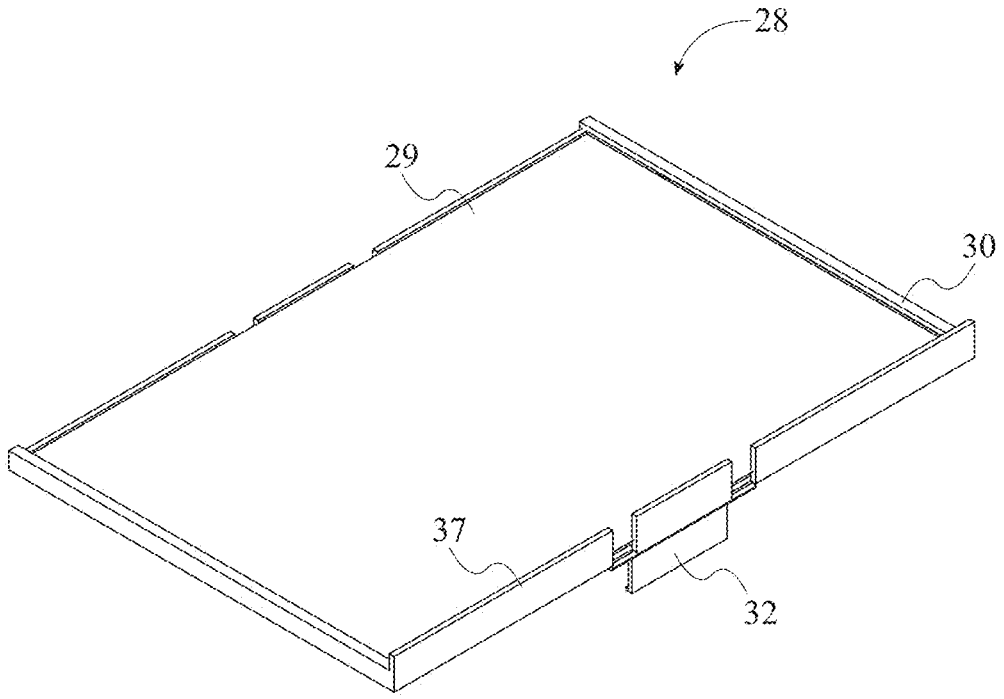
FIG. 29 is a top-front-left perspective view of the laptop tray of the present invention, wherein the laptop tray is shown in a collapsed configuration.
Figure 30:
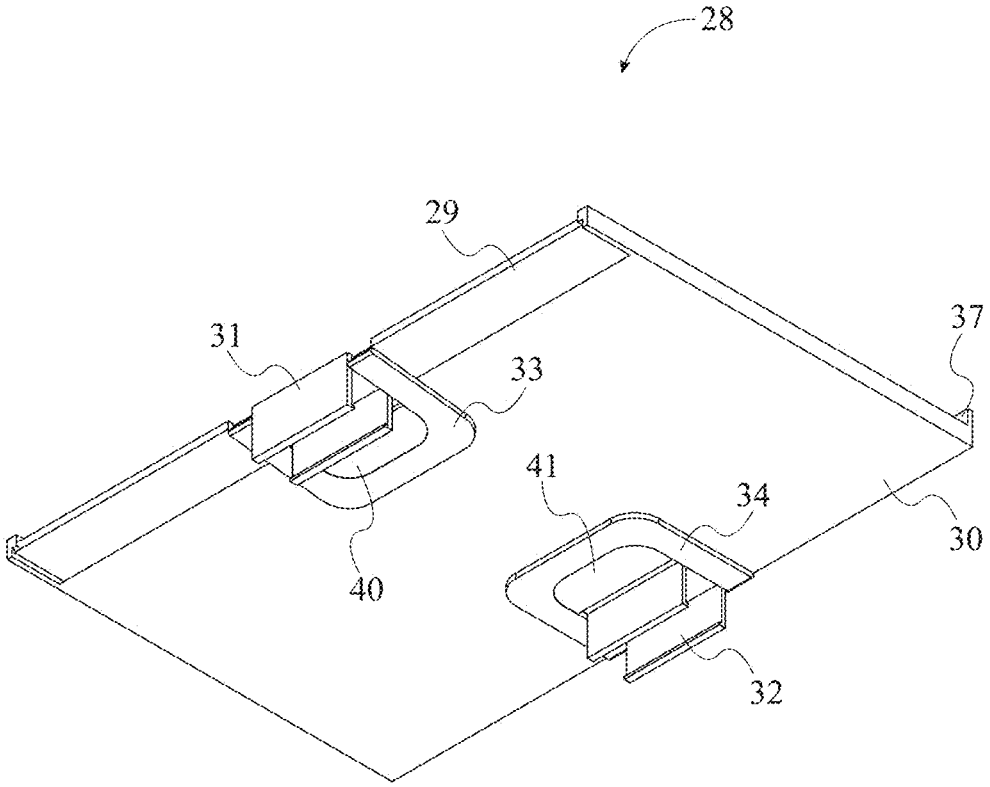
FIG. 30 is a bottom-front-right perspective view thereof.
Figure 31:
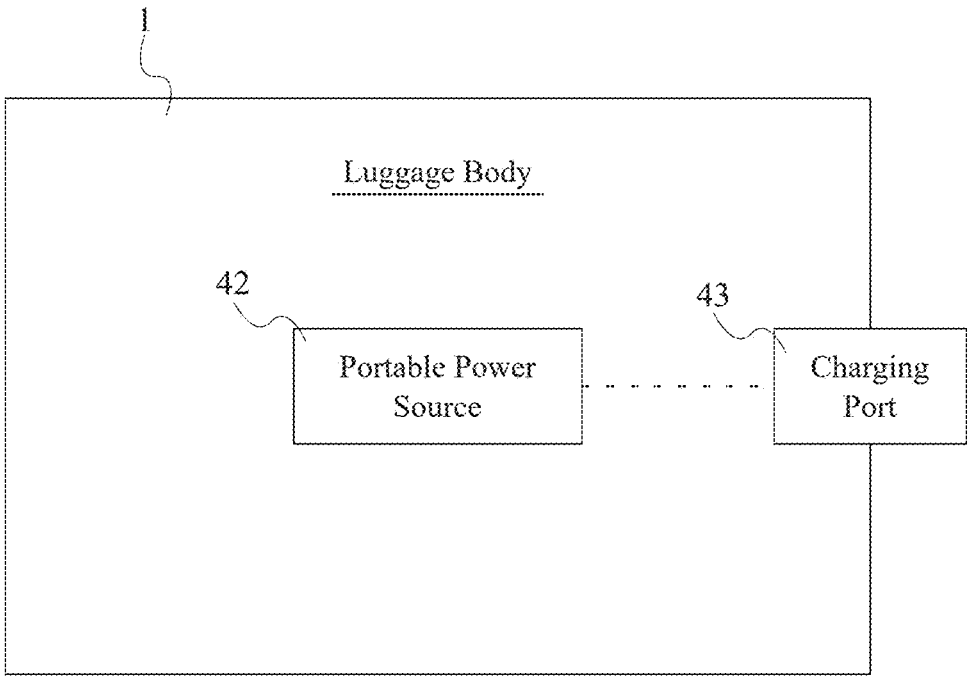
FIG. 31 is a block diagram showing the electrical connection between a portable power source and a charging port of the present invention, wherein the electrical connection is shown in dashed lines.

Further, to help store the laptop tray 28 on the luggage body 1, the present invention may further comprise a tray-storing pocket 35. As can be seen in FIGS. 19 and 20, the tray-storing pocket 35 is designed to receive the laptop tray 28 in the collapsed configuration as well as the laptop or computing device within the same storage space in the luggage body 1 to reduce the overall baggage the user must carry. To do so, the tray-storing pocket 35 is integrated into the luggage body 1, adjacent to the front body 2 so that the laptop tray 28 and the laptop can be easily retrieved when desired. Like the luggage body 1, the tray-storing pocket 35 may comprise a fastening mechanism that enables the user to seal the opening of the tray-storing pocket 35. Further, a locking mechanism can be implemented on the opening of the tray-storing pocket 35 to prevent unauthorized access into the tray-storing pocket 35. In other embodiments, different storage spaces can be provided on the luggage body 1 to accommodate the laptop tray 28, the laptop, or other computing devices or accessories.

The luggage body 1 is preferably designed to be comfortably moved by the user using the pull handle 8 in the handle configuration. As can be seen in FIGS. 1 through 24, to further facilitate the transportation of the luggage body 1, the present invention may further comprise a plurality of caster wheels 36. The plurality of caster wheels 36 reduces the friction between the bottom side 5 and the ground so that the user does not have to exert too much effort to move the luggage body 1. So, the plurality of caster wheels 36 is peripherally distributed around the bottom side 5. For example, in the rectangular embodiment of the present invention, four caster wheels can be implemented. A caster wheel can be positioned on each corner of the bottom side 5 to provide stability to the luggage body 1 when pulled from the pull handle 8. Further, each of the plurality of wheels can be externally mounted onto the bottom side 5 to secure the plurality of wheels to the luggage body 1.

In some embodiments, the plurality of caster wheels 36 can be a plurality of retractable caster wheels that can be stored away to reduce the overall height of the luggage body 1. As can be seen in FIGS. 17 through 24, the plurality of retractable caster wheels also enables the luggage body 1 to have a more stable base when luggage body 1 is placed on the ground in an upright orientation. Each of the plurality of retractable caster wheels can include a corresponding wheel compartment adjacent to each caster wheel that can accommodate each caster wheel when stored away. In other embodiments, different retracting mechanisms can be implemented to help store the plurality of caster wheels 36 as desired. In addition, different luggage features can be incorporated into the luggage body 1 to increase the functionality of the luggage body 1.

As previously discussed, the present invention can include a power source within the luggage body 1 to power electrical or electronic devices, such as the laptop or other computing devices. As can be seen in FIGS. 1 through 24 and 29, the present invention may further comprise a portable power source 42 and at least one charging port 43. The portable power source 42 can be a compact portable battery provided within the luggage body 1 to provide the power necessary to recharge the desired electrical or electronic devices. The charging port 43 enables the recharging of the portable power source 42 from an external power source as well as the charging of the desired electrical or electronic devices using the stored power in the portable power source 42. For example, the charging port 43 can be a Universal Serial Bus (USB) charging port or any other conventional types of charging ports. To do so, the portable power source 42 is mounted within the luggage body 1 to isolate the portable power source 42 from the luggage body 1 surroundings. Further, the at least one charging port 43 is laterally integrated into the luggage body 1 so that the at least one charging port 43 can be accessed by the user from outside the luggage body 1. Furthermore, the at least one charging port 29 is electrically connected to the portable power source 42 to enable the flow of electricity between the components. In other embodiments, different charging systems and devices can be implemented into the present invention.

Although the invention has been explained in relation to its preferred embodiment, it is to be understood that many other possible modifications and variations can be made without departing from the spirit and scope of the invention.

What is claimed is:

1. A piece of luggage with a handle-to-stand conversion feature comprising:

a luggage body;

a pull handle;

a tray-storing pocket;

the luggage body comprising a front side, a rear side, a top side, and a bottom side;

the pull handle comprising a first hinged telescopic support, a second hinged telescopic support, and a crossbar;

the first hinged telescopic support and the second hinged telescopic support being positioned parallel and offset from each other;

the first hinged telescopic support and the second hinged telescopic support being anchored into the luggage body, adjacent to the rear side;

the crossbar being positioned external to the luggage body, adjacent to the top side;

the crossbar being terminally connected in between the first hinged telescopic support and the second hinged telescopic support, offset from the luggage body; and the tray-storing pocket being integrated into the luggage body, adjacent to the front side.

2. The piece of luggage with a handle-to-stand conversion feature as claimed in claim 1 comprising:

the first hinged telescopic support and the second hinged telescopic support each comprising a distal support bar, a proximal support bar, and a structural support tube;

the distal support bar comprising a fixed bar end and a free bar end;

the structural support tube being integrated into the luggage body, adjacent to the rear side;

the proximal support bar being telescopically engaged into the structural support tube;

the fixed bar end being hingedly and terminally connected to the proximal support bar, offset from the structural support tube;

the free bar end of the first hinged telescopic support being terminally connected to the crossbar; and the free bar end of the second hinged telescopic support being terminally connected to the crossbar, opposite to the free bar end of the first hinged telescopic support.

3. The piece of luggage with a handle-to-stand conversion feature as claimed in claim 2 comprising:

the first hinged telescopic support and the second hinged telescopic support each further comprising a lockable U-joint; and the fixed bar end being hingedly and terminally connected to the proximal support bar, offset from the structural support tube, by the lockable U-joint.

4. The piece of luggage with a handle-to-stand conversion feature as claimed in claim 2 comprising:

the first hinged telescopic support and the second hinged telescopic support each further comprising a kickout support rod and a rod-receiving slot;

the kickout support rod comprising a fixed rod end and a free rod end;

the rod-receiving slot laterally traversing into the distal support bar;

the fixed rod end being positioned within the rod-receiving slot; and the fixed rod end being hingedly connected to the distal support bar.

5. The piece of luggage with a handle-to-stand conversion feature as claimed in claim 1 comprising:

at least one rear kick stand;

the luggage body further comprising at least one rear stand-receiving slot;

the at least one rear kick stand comprising a rear fixed stand end and a rear free stand end;

the at least one rear stand-receiving slot traversing from the rear side into the luggage body;

the at least one rear stand-receiving slot being positioned adjacent to the bottom side;

the rear fixed stand end being positioned within the at least one rear stand-receiving slot; and the rear fixed stand end being hingedly connected to the luggage body.

6. The piece of luggage with a handle-to-stand conversion feature as claimed in claim 1 comprising:

at least one front kick stand;

the luggage body further comprising at least one front stand-receiving slot;

the at least one front kick stand comprising a front fixed stand end and a front free stand end;

the at least one front stand-receiving slot traversing from the front side into the luggage body;

the at least one front stand-receiving slot being centrally positioned in between the top side and the bottom side;

the front fixed stand end being positioned within the at least one front stand-receiving slot; and the front fixed stand end being hingedly connected to the luggage body.

7. The piece of luggage with a handle-to-stand conversion feature as claimed in claim 1 comprising:

a deployable foot stand;

the luggage body further comprising a stand-receiving slot;

the stand-receiving slot being centered on the bottom side, adjacent to the front side;

the stand-receiving slot traversing from the bottom side into the luggage body; and the deployable foot stand being mounted into the stand-receiving slot.

8. The piece of luggage with a handle-to-stand conversion feature as claimed in claim 1 comprising:

a laptop tray;

a first clamp;

a second clamp;

the first clamp and the second clamp being connected onto the laptop tray; and the first clamp and the second clamp being positioned offset from each other across the laptop tray.

9. The piece of luggage with a handle-to-stand conversion feature as claimed in claim 8 comprising:

wherein the laptop tray and the pull handle are arranged into a platform configuration;

the laptop tray being positioned parallel to the top side;

the laptop tray being laterally attached to the first hinged telescopic support by the first clamp; and the laptop tray being laterally attached to the second hinged telescopic support by the second clamp.

10. The piece of luggage with a handle-to-stand conversion feature as claimed in claim 8 comprising:

the laptop tray comprising a first tray portion and a second tray portion;

the first tray portion and the second tray portion being telescopically engaged to each other;

the first clamp being attached onto the first tray portion, offset from the second tray portion; and the second clamp being attached onto the second tray portion, offset from the first tray portion.

11. The piece of luggage with a handle-to-stand conversion feature as claimed in claim 8 comprising:

at least one tray ledge;

the at least one tray ledge being peripherally connected onto the laptop tray, opposite to the first clamp and the second clamp; and the at least one tray ledge being positioned along the second clamp.

12. The piece of luggage with a handle-to-stand conversion feature as claimed in claim 11 comprising:

wherein the laptop tray and the pull handle are arranged into a first holder configuration;

the laptop tray being positioned perpendicular to the top side; and the laptop tray being laterally attached to the crossbar by the first clamp.

13. The piece of luggage with a handle-to-stand conversion feature as claimed in claim 8 comprising:

at least one tray ledge;

the at least one tray ledge being peripherally connected onto the laptop tray, opposite to the first clamp and the second clamp; and the at least one tray ledge being positioned in between the first clamp and the second clamp.

14. The piece of luggage with a handle-to-stand conversion feature as claimed in claim 13 comprising:

wherein the laptop tray and the pull handle are arranged into a second holder configuration;

the laptop tray being positioned perpendicular to the top side;

the laptop tray being laterally attached to the first hinged telescopic support by the first clamp; and the laptop tray being laterally attached to the second hinged telescopic support by the second clamp.

15. The piece of luggage with a handle-to-stand conversion feature as claimed in claim 8 comprising:

a first retractable handle;

a second retractable handle;

the first retractable handle being peripherally connected to the laptop tray; and the second retractable handle being peripherally connected to the laptop tray, opposite to the first retractable handle.

16. The piece of luggage with a handle-to-stand conversion feature as claimed in claim 15 comprising:

a first light source;

a second light source;

the first light source being integrated into the first retractable handle; and the second light source being integrated into the second retractable handle.

17. The piece of luggage with a handle-to-stand conversion feature as claimed in claim 1 comprising:

a plurality of caster wheels;

the plurality of caster wheels being peripherally distributed around the bottom side; and each of the plurality of wheels being externally mounted onto the bottom side.

18. The piece of luggage with a handle-to-stand conversion feature as claimed in claim 17, wherein the plurality of caster wheels is a plurality of retractable caster wheels.

19. The piece of luggage with a handle-to-stand conversion feature as claimed in claim 1 comprising:

a portable power source;

at least one charging port;

the portable power source being mounted within the luggage body;

the at least one charging port being laterally integrated into the luggage body; and the at least one charging port being electrically connected to the portable power source.

* * * * *